US008252500B2

(12) United States Patent
Watanabe et al.

(10) Patent No.: US 8,252,500 B2
(45) Date of Patent: Aug. 28, 2012

(54) TONER, AND METHOD FOR PRODUCING THE SAME

(75) Inventors: Yohichiroh Watanabe, Fuji (JP); Kazumi Suzuki, Shizuoka (JP); Shinji Ohtani, Shizuoka (JP); Takahiro Honda, Fujinomiya (JP); Yoshihiro Norikane, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 445 days.

(21) Appl. No.: 12/441,248

(22) PCT Filed: Jun. 12, 2008

(86) PCT No.: PCT/JP2008/061183

§ 371 (c)(1),
(2), (4) Date: Mar. 13, 2009

(87) PCT Pub. No.: WO2009/008251

PCT Pub. Date: Jan. 15, 2009

(65) Prior Publication Data

US 2009/0325100 A1 Dec. 31, 2009

(30) Foreign Application Priority Data

Jul. 12, 2007 (JP) ..... 2007-183155

(51) Int. Cl.
*G03G 9/087* (2006.01)

(52) U.S. Cl. ..... 430/137.1; 430/109.3; 430/109.4

(58) Field of Classification Search ..... 430/109.3, 430/109.4, 137.1
See application file for complete search history.

(56) References Cited

U.S. PATENT DOCUMENTS

| | | | | |
|---|---|---|---|---|
| 4,267,246 | A | 5/1981 | Nishibayashi et al. | |
| 2002/0042011 | A1 | 4/2002 | Anno et al. | |
| 2003/0224271 | A1 | 12/2003 | Teshima | |
| 2004/0048183 | A1 * | 3/2004 | Teshima | 430/137.1 |
| 2004/0152006 | A1 | 8/2004 | Teshima | |
| 2004/0209181 | A1 | 10/2004 | Higuchi et al. | |
| 2005/0154088 | A1 * | 7/2005 | Miura et al. | 523/223 |
| 2005/0277043 | A1 | 12/2005 | Tanma et al. | |
| 2006/0115756 | A1 * | 6/2006 | Komatsu et al. | 430/105 |
| 2006/0142425 | A1 * | 6/2006 | Akioka et al. | 523/223 |

FOREIGN PATENT DOCUMENTS

| | | |
|---|---|---|
| JP | 54 5434 | 1/1979 |
| JP | 7 152202 | 6/1995 |
| JP | 2003 262976 | 9/2003 |

(Continued)

OTHER PUBLICATIONS

Abstract of JP 2006064351 Mar. 9, 2006.*

(Continued)

*Primary Examiner* — Hoa V Le
(74) *Attorney, Agent, or Firm* — Oblon, Spivak, McClelland, Maier & Neustadt, L.L.P.

(57) ABSTRACT

The present invention provides a toner containing at least two binder resins composed of at least a resin A and a resin B which are incompatible with each other, and a colorant, wherein the toner has an average circularity of 0.93 to 0.98 and is produced by atomizing a toner composition liquid in a vapor phase to form liquid droplets and solidifying the liquid droplets, and the toner composition liquid is prepared by dissolving or dispersing the at least two binder resins and the colorant in an organic solvent.

1 Claim, 13 Drawing Sheets

FOREIGN PATENT DOCUMENTS

| | | | |
|---|---|---|---|
| JP | 2003 262977 | | 9/2003 |
| JP | 2003 280236 | | 10/2003 |
| JP | 2003 280244 | | 10/2003 |
| JP | 2004 109697 | | 4/2004 |
| JP | 2004 157267 | | 6/2004 |
| JP | 2004 246348 | | 9/2004 |
| JP | 2006064351 | * | 3/2006 |
| JP | 2006 126529 | | 5/2006 |
| JP | 2006 297325 | | 11/2006 |

OTHER PUBLICATIONS

Machine English language translation of JP 2006064351 Mar. 9, 2006.*

Canadian Office Action issued Dec. 15, 2010, in Patent Application No. 2,663,255.

Supplementary European Search Report issued Apr. 4, 2012 in PCT/JP2008/061183 filed Jun. 12, 2008.

* cited by examiner

TONER, AND METHOD FOR PRODUCING THE SAME

TECHNICAL FIELD

The present invention relates to a toner used in a developer for developing a latent electrostatic image in electrophotography, electrostatic recording, electrostatic printing and the like, and a method for producing a toner.

BACKGROUND ART

A toner used in electrophotography, electrostatic recording, electrostatic printing or the like is, for example, in a developing step, once adhered to an image bearing member such as a latent electrostatic image bearing member, on which surface a latent electrostatic image has been formed, is then transferred from the latent electrostatic image onto a transfer medium such as a transfer paper sheet in a transfer step, thereafter, is fixed on the surface of the paper sheet in a fixing step. At that time, since an untransferred toner which remains as residual toner on the latent electrostatic image bearing member with a latent image held on its surface, there is a need to remove the residual toner so as not to prevent the subsequent formation of a latent electrostatic image. In order to remove such residual toner, blade cleaning devices, which are simple in structure and enable obtaining favorable cleanability, are frequently used, however, it is known that the smaller a toner particle size and the closer a toner to a spherical shape, the more difficult it is to remove the toner from a surface of a latent electrostatic image bearing member.

Conventionally, as a dry-process toner used in electrophotography, electrostatic recording, electrostatic printing or the like, a so-called "pulverized toner" is widely used, in which a binder resin or binder resins, such as styrene resin and polyester resin, are fused and kneaded together with a colorant or the like.

However, in recent years, to obtain high-quality images, toners tend to become smaller in size. Therefore, when a toner is made to have a small particle size of 6 μm or less with the use of such a pulverization method, the pulverization efficiency is reduced and the production loss is increased, resulting in a low productivity and high costs.

To avoid the above-mentioned problems, a suspension polymerization method, an emulsion polymerization/flocculation method and the like used for producing a so-called "polymerized toner", and a toner production method called "polymer dissolution suspension method" which is accompanied by volume shrinkage have been proposed and put in practical use (see Patent Literature 1). The toner production method is excellent in producing toner particles small in size, however, basically, a toner having a substantially spherical shape is produced. In the meanwhile, techniques to make a toner have an irregular shape or non-spherical shape are found out, and it becomes possible to obtain toners to be readily removed by blade cleaning by the use of an emulsion polymerization aggregation method or a polymer dissolution suspension method. Whereas, in these methods, toner particles are formed and produced in an aqueous medium, and thus it is necessary to dry water, which has a large amount of latent heat of vaporization, and a large amount of energy for drying is required. Further, it has been known that these methods assume that a dispersant is used in an aqueous medium, and thus such a dispersant that may impair the electrostatic property of a toner remains on a surface of the toner, causing problems such as adverse effects on environmental stability. Further, in order to remove the dispersant, a great amount of washing water is required. For this reason, toners produced by these methods and these toner production methods are still far from satisfaction.

As an alternative to the methods described above, a method of producing a toner with no use of aqueous medium is proposed which includes the steps of atomizing and jetting a toner composition liquid prepared by dissolving or dispersing a toner composition in a vapor phase to form liquid droplets and removing organic solvents therein to thereby yield toner particles (see Patent Literature 2). Further, a method is proposed which includes the steps of forming minute liquid droplets by utilizing thermal expansion inside nozzles and drying the liquid droplets so as to be solidified (see Patent Literature 3). A method is also proposed in which similar steps to the above method are employed by utilizing an acoustic lens (see Patent Literature 4).

However, these methods have shortcomings that the number of liquid droplets that can be ejected from one nozzle per unit of time is limited, resulting in poor productivity, and it is difficult to prevent the particle size distribution from widening due to coalescence of liquid droplets and therefore the method is also far from satisfaction in terms of monodispersibility. Furthermore, a toner that can be obtained by the method is also disadvantageous in that toner particles are formed in spherical shape due to the surface tension of the toner composition liquid used.

Patent Literature 1 Japanese Patent Application Laid-Open (JP-A) No. 7-152202

Patent Literature 2 Japanese Patent Application Laid-Open (JP-A) No. 2003-262976

Patent Literature 3 Japanese Patent Application Laid-Open (JP-A) No. 2003-280236

Patent Literature 4 Japanese Patent Application Laid-Open (JP-A) No. 2003-262977

DISCLOSURE OF INVENTION

The present invention aims to provide a toner that is small in particle size and achieves shape irregularity of toner particles, i.e. formation of irregularly shaped toner particles, while the toner is produced by atomizing and jetting a toner composition liquid in a vapor phase without using an aqueous medium containing a dispersant, which may impair the electrostatic property, and is excellent in blade cleanability, as well as to provide a method for producing a toner.

Further, the present invention also aims to provide a toner capable of obtaining excellent blade cleanability in a stable manner because the toner has non-spherical shape and is composed of particles having monodispersibility in unprecedented grain size, and thus the toner has an extremely less amount of fine powder which could degrade blade cleanability as well as to provide a method for producing a toner.

As a result of earnestly carrying out repeated examinations to solve the above-mentioned problems, the present inventors found that as a toner that is produced by forming toner particles by atomizing in a vapor phase a toner composition liquid in which at least two or more binder resins and a colorant are dissolved or dispersed in an organic solvent, it is possible to obtain a toner having an average circularity of from 0.93 to 0.98 by using, as the binder resins, a resin A and a resin B incompatible with each other, and forming particles of the toner composition liquid in a vapor phase.

The present invention is based upon the findings of the inventors, and means for solving the above-mentioned problems are as follows.

<1> A toner containing at least two binder resins composed of at least a resin A and a resin B which are incompatible with each other, and a colorant, wherein the toner has an average circularity of 0.93 to 0.98 and is produced by atomizing a toner composition liquid in a vapor phase to form liquid droplets and solidifying the liquid droplets, and the toner composition liquid is prepared by dissolving or dispersing the at least two binder resins and the colorant in an organic solvent.

<2> The toner according to the item <1>, wherein the toner composition liquid has a solid content of 5% by mass to 40% by mass.

<3> The toner according to any one of the items <1> and <2>, wherein the resin A is any one of a polyester resin and a polyol resin.

<4> The toner according to any one of the items <1> to <3>, wherein the resin A and the resin B are any one of a combination of a polyester resin with a styrene-(meth)acrylic resin and a combination of a polyol resin with a styrene-(meth)acrylic resin.

<5> The toner according to any one of the items <1> to <4>, wherein the toner composition liquid contains a releasing agent.

<6> The toner according to any one of the items <1> to <5>, wherein the toner has a volume average particle diameter of 1 μm to 10 μm and a particle size distribution (volume average particle diameter/number average particle diameter) of 1.00 to 1.10.

<7> A method for producing a toner, including:

forming liquid droplets by atomizing a toner composition liquid in a vapor phase, and solidifying the formed liquid droplets, wherein the toner is a toner according to any one of the items <1> to <6>, and in the toner composition, at least a resin A and a resin B as binder resins incompatible with each other and a colorant are dissolved or dispersed in an organic solvent.

<8> The method according to the item <7>, wherein in the formation of liquid droplets, the liquid droplets are formed using a multiple-fluid spray nozzle.

<9> The method according to the item <7>, wherein in the formation of liquid droplets, the liquid droplets are formed using a rotation disc type sprayer.

<10> The method according to the item <7>, wherein in the formation of liquid droplets, the toner composition liquid is periodically discharged from a thin film having a plurality of nozzles provided on a reservoir for reserving the toner composition, by a mechanically vibrating unit so as to form liquid droplets; and the mechanically vibrating unit is a vibration generating unit that is formed in a circular ring shape so as to surround the thin film.

<11> The method according to the item <7>, wherein in the formation of liquid droplets, the toner composition liquid is periodically discharged from a thin film having a plurality of nozzles provided on a reservoir for reserving the toner composition, by a mechanically vibrating unit so as to form liquid droplets; and the mechanically vibrating unit has a vibrating surface formed in parallel with the thin film and vibrating perpendicularly to the thin film.

<12> A toner produced by the method for producing a toner, according to any one of the items <7> to <11>.

According to the present invention, a toner having a small particle size and capable of obtaining high quality images can be efficiently produced with low energy, and the present invention can provide a toner capable of stably obtaining superior blade cleanability to those of conventional toners having a small particle size, and can provide a method for producing a toner.

Figure 1:
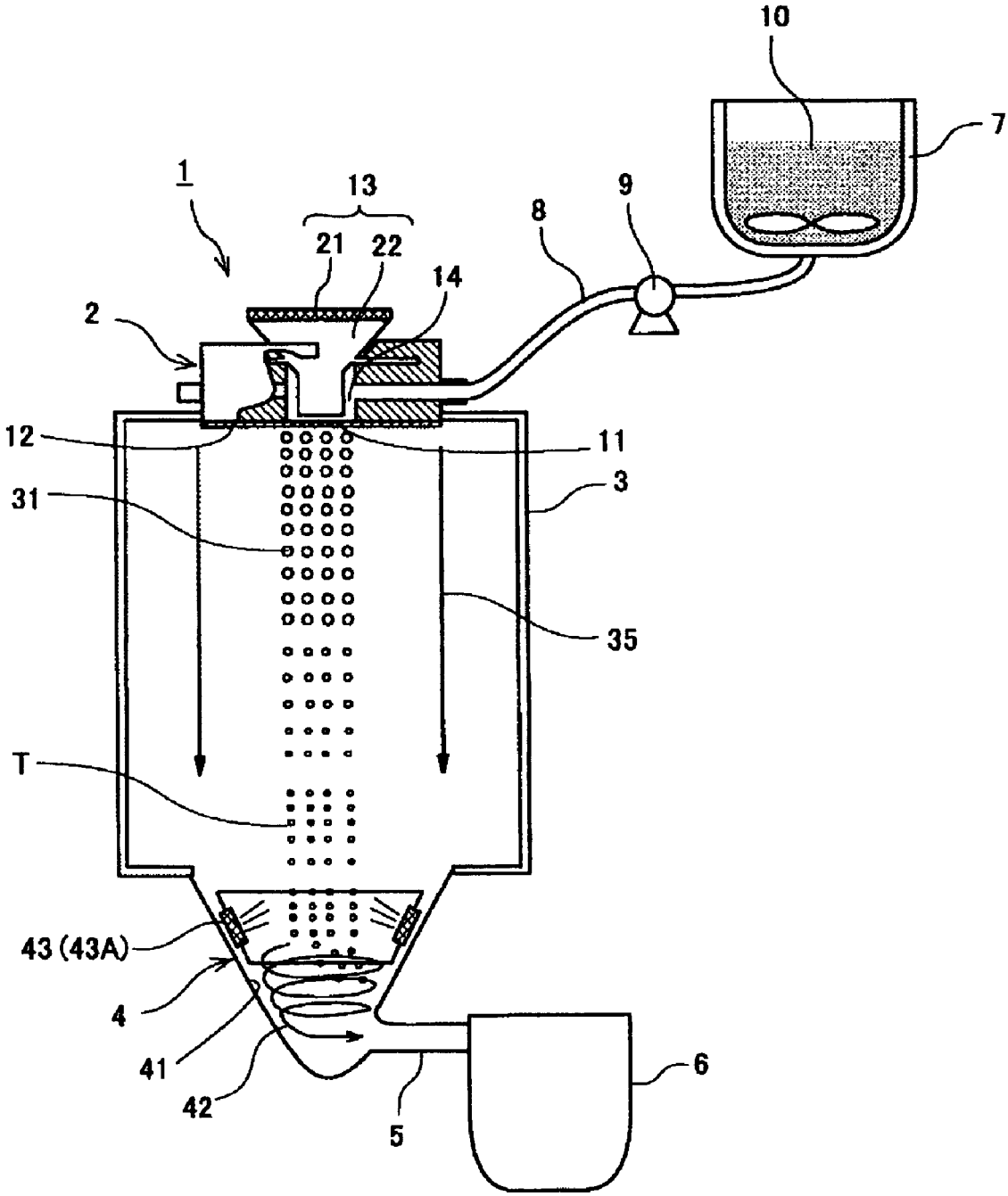
FIG. 1 is a schematic structural view showing one example of a toner production apparatus with which a method for producing a toner of the present invention is used.

BEST MODE FOR CARRYING OUT THE INVENTION (Toner)

A toner of the present invention is produced by atomizing a toner composition liquid in a vapor phase to form liquid droplets and solidifying the liquid droplets, and the toner composition liquid is prepared by dissolving or dispersing in an organic solvent at least two binder resins, a colorant and further other components selected in accordance with the necessity.

<Binder Resin>

The at least two binder resins contain at least a resin A and a resin B which are incompatible with each other.

Note that the phrase "incompatible with each other" means that a micro-structure of resin components obtained by dissolving or dispersing the resin A and the resin B in a solvent and drying the dispersion liquid is in a state of being phase-separated.

Whether or not the resins A and B are incompatible with each other can be determined based on the following procedures. When a dried product obtained by dissolving the resins A and B in a solvent and drying the dispersion liquid is opaque, the dried product is phase-separated and it is determined that the resin A and the resin B are incompatible with each other. If the dried product is transparent, then the dried product is cut out into an ultrathin section using a microtome, the ultrathin section is stained with $RuO_4$ or the like, the stained section is observed with a transmission electron microscope (TEM). If the section of the dried product is phase-separated, it is determined that the resin A and the resin B are incompatible with each other.

Usually, it is considered that a toner prepared by forming liquid droplets and solidifying the liquid droplets in a vapor phase is formed in a spherical shape and is not formed in an irregular shape. But, it is possible to obtain a toner having an average circularity of 0.93 to 0.98 by using as resin components the resin A and the resin B which are incompatible with each other because the product becomes to have an irregular shape in the process of solidification, although formed in a spherical shape in the process of formation of liquid droplets.

Whether or not the toner becomes to have an irregular shape when dried is not clear, and it is presumed that the irregularization of the shape of the toner takes place because the rate of volume shrinkage associated with drying differs between the resin solutions differs between the resin solutions due to a difference in affinity for a solvent used between the resin A and the resin B which are incompatible with each other and due to a difference in concentration of the solvent in each of the resin solutions and a difference in drying rate between the resin solutions in a phase-separated state in the course of drying. Further, it is conceived that the irregularization of the shape is promoted by employing a configuration where a large amount of solvent is contained inside toner particles, and a slow-drying resin is used.

The binder resins are not particularly limited, may be suitably selected among from toner-binder resins known in the art, however, it is preferable that the binder resins do not have a cross-linked structure because they are required to be soluble in solvents.

Examples of the binder resins include vinyl polymers such as styrene monomers, acrylic monomers, and methacrylic monomers; copolymers composed of any one of these monomers or two or more of these monomers, polyester resins, polyol resins, phenol resins, polyurethane resins, polyamide resins, epoxy resins, xylene resins, terpene resins, coumarone-indene resins, polycarbonate resins, and petroleum resins.

Of these, as the resin A, a polyester resin or a polyol resin is preferable. It is particularly preferable that the resin A and the resin B are any one of a combination of a polyester resin with a styrene-(meth)acrylic acid, and a combination of a polyol resin with a styrene-(meth)acrylic resin.

Note that as for the binder resins, at least two binder resins are required to be incompatible with each other, and when three or more binder resins are mixed and used, these resins may be compatible or incompatible with the resins A and B, however, it is impossible to use such a resin that makes the resins A and B compatible with each other.

The mass ratio of the resin A to the resin B (A:B) is preferably 1:99 to 99:1 and more preferably 5:95 to 95:5.

For the styrene-(meth)acrylate resin, a copolymer between styrene monomer and (meth)acrylic monomer is preferably used.

Examples of the styrene monomer include styrene, styrenes such as o-methylstyrene, m-methylstyrene, p-methylstyrene, p-phenylstyrene, p-ethylstyrene, 2,4-dimethylstyrene, p-n-amyl styrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, or the derivatives thereof.

For the acrylic monomer, acrylic acid or esters thereof may be used. Examples of the esters of acrylic acid include methyl acrylate, ethyl acrylate, propyl acrylate, n-butyl acrylate, isobutyl acrylate, n-octyl acylate, n-dodecyl acrylate, 2-ethyl hexyl acrylate, stearyl acrylate, 2-choloroethyl acrylate, and phenyl acrylate.

For the methacrylic monomer, methacrylic acid and esters thereof may be used. Examples of the esters of methacrylic acid include methyl methacrylate, ethyl methacrylate, propyl methacrylate, n-butyl methacrylate, isobutyl methacrylate, n-octyl methacrylate, n-dodecyl methacrylate, 2-ethyl hexyl methacrylate, stearyl methacrylate, phenyl methacrylate, dimethylaminoethyl methacrylate, and diethylaminoethyl methacrylate.

A polymerization initiator used in producing a copolymer between the styrene monomer and the acrylic monomer is not particularly limited and may be suitably selected in accordance with the intended use. Examples thereof include 2,2'-azobisisobutylonitrile, 2,2'-azobis(4-methoxy-2,4-dimethylvalelonitrile), 2,2'-azobis(2,4-dimethylvalelonitrile), 2,2'-azobis(2-methylbutylonitrile), dimethyl-2,2'-azobisisobutylate, 1,1'-azobis(1-cyclohexanecarbonitrile), 2-(carbamoylazo)-isobutylonitrile, 2,2' azobis(2,4,4-trimethylpentane), 2-phenylazo-2',4'-dimethyl-4'-methoxyvaleronitrile, 2,2'-azobis(2-methylpropane); ketone peroxides such as methylethylketone peroxide, acetylacetone peroxide, and cyclohexanone peroxide; 2,2-bis(tert-butylperoxy)butane, tert-butyl hydroperoxide, cumene hydroperoxide, 1,1,3,3-tetramethylbutyl hydroperoxide, di-tert-butylperoxide, tert-butylcumyl peroxide, dicumyl peroxide, α-(tert-butylperoxy) isopropyl benzene, isobutyl peroxide, octanoyl peroxide, decanoyl peroxide, lauroyl peroxide, 3,5,5-trimethylhexanoyl peroxide, benzoyl peroxide, m-tolylperoxide, di-isopropyl peroxydicarbonate, di-2-ethylhexyl peroxydicarbonate, di-n-propylperoxydicarbonate, di-2-ethoxyethyl peroxydicarbonate, di-ethoxyisopropylperoxydicarbonate, di(3-methyl-3-methoxybutyl) peroxycarbonate, di(3-methyl-3-methoxybutyl) peroxycarbonate, acetylcyclohexy sulfonyl peroxide, tert-butylperoxy acetate, tert-butylperoxy-isobutylate, tert-butylperoxy-2-ethylhexalate, tert-butylperoxy laurate, tert-butyl-oxybenzoate, tert-butylperoxy isopropyl carbonate, di-tert-butylperoxy isophthalate, tert-butylperoxyallylcarbonate, isoamylperoxy-2-ethylhexanoate, d-tert-butylperoxy hexahydro terephthalate, and tert-butylperoxy azelate.

—Polyester Resin—

For the monomer constituting the polyester resin, for example, divalent alcohol components and acidic components are exemplified.

Examples of the divalent alcohol components include ethylene glycol, propylene glycol, 1,3-butanediol, 1,4-butanediol, 2,3-butanediol, diethylene glycol, triethylene glycol, 1,5-pentanediol, 1,6-hexadiol, neopentyl glycol, 2-ethyl-1,3-hexanediol, and diols obtained by polymerizing a cyclic ether such as ethylene oxide and propylene oxide with hydrogenated bisphenol A or bisphenol A.

Examples of the acidic components include benzene dicarboxylic acids such as phthalic acid, isophthalic acid, and terephthalic acid or anhydrides thereof; alkyl dicarboxylic acids such as succinic acid, adipic acid, sebacic acid, and azelaic acid or anhydrides thereof; unsaturated dibasic acids such as maleic acid, citraconic acid, itaconic acid, alkenyl succinic acid, fumaric acid and methaconic acid; and unsaturated dibasic acid anhydrides such as maleic anhydride, citraconic anhydride, itaconic anhydride, and alkenyl succinic anhydride. Further, examples of trivalent or more-valued carboxylic acid component include trimellitic acid, pyromellitic acid, 1,2,4-benzene tricarboxylic acid, 1,2,5-benzene tricarboxylic acid, 2,5,7-naphthalene tricarboxylic acid, 1,2,4-butane tricarboxylic acid, 1,2,5-hexane tricarboxylic acid, 1,3-dicarboxy-2-methyl-2-methylene carboxy propane, tetra(methylenecarboxy)methane, 1,2,7,8-octanetetracarboxylic acid, Empol trimer acid or anhydrides thereof, and partially lower alkyl esters.

—Polyol Resin—

The polyol resin is a polyether polyol resin having an epoxy skeleton. For example, a polyol resin obtained by reacting (1) epoxy resin, (2) alkylene oxide adduct of divalent phenol or glycidyl ether thereof, and (3) a compound having an active hydrogen reactive with epoxy group is preferably used.

The binder resins preferably have a glass transition temperature (Tg) of 35° C. to 80° C. and more preferably of 40° C. to 75° C. from the perspective of storage stability of toner. When the glass transition temperature (Tg) is lower than 35° C., the toner is liable to deteriorate under high-temperature atmosphere, and when higher than 80° C., the fixing property of the toner may possibly degrade.

<Colorant>

The colorant is not particularly limited and may be suitably selected from among commonly used dyes and pigments in accordance with the intended use. Examples thereof include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone.

The content of the colorant in the toner is preferably 1% by mass to 15% by mass and more preferably 3% by mass to 10% by mass.

The colorant may be used as a masterbatch obtained by combining the colorant and a resin. Examples of a binder resin to be kneaded together with a masterbatch, besides the modified or unmodified polyester resins mentioned above, include styrenes such as polystyrene, poly-p-chlorostyrene, and polyvinyl toluene and polymers of substitution products thereof; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleate copolymer; polymethyl methacrylate, polybutyl methacrylate, polyvinyl chlorides, polyvinyl acetates, polyethylenes, polypropylenes, polyesters, epoxy resins, epoxy polyol resins, polyurethanes, polyamides, polyvinyl butyrals, polyacrylic resins, rosins, modified rosins, terpene resins, aliphatic or alicyclic hydrocarbon resins, aromatic petroleum resins, chlorinated paraffins, and paraffin waxes. These may be used alone or in combination.

The masterbatch may be obtained by mixing and kneading the resin for masterbatch and the colorant under application of high shear force. At this time, it is preferable to use an organic solvent to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because wet cake of the colorant may be directly used without drying the cake. For the mixing and kneading, a high-shearing dispersion apparatus such as a triple roll mill is preferably used.

The use amount of the masterbatch is preferably 0.1 parts by mass to 20 parts by mass to 100 parts by mass of the binder resins.

It is preferable to use the resin for masterbatch in a state of having an acid value of 30 mgKOH/g or less and an amine value of 1 to 100 and making a colorant dispersed therein. It is more preferable to use the resin for masterbatch in a state of having an acid value of 20 mgKOH/g or less and an amine value of 10 to 50 and making a colorant dispersed therein. When the acid value is greater than 30 mgKOH/g, the electrostatic property of the toner may be reduced under high-humidity environment and the pigment dispersibility may become insufficient. When the amine value is less than 1 or more than 100, the pigment dispersibility may also become insufficient. Note that the acid value can be measured by the method described in JIS K0070, and the amine value can be measured by the method described in JIS K7237.

Further, it is preferable that the dispersant be highly compatible with the binder resins. Examples of specific commercially available products of the dispersant include "AJISPER PB821" and "AJISPER PB822" (manufactured by Ajinomoto Fine-Techno Co., Inc.); "DISPERBYK-2001" (manufactured by BYK Chemie Japan); "EFKA-4010" and (manufactured by EFKA Chemicals).

The amount of the dispersant to be added in the toner is preferably 0.1% by mass to 10% by mass based on the colorant used. The additive amount of the dispersant is less than 0.1% by mass, the pigment dispersibility may become insufficient, and when more than 10% by mass, the electrostatic property of the toner may be reduced under high-humidity environment.

The mass average molecular weight of the dispersant determined by gel permeation chromatography (GPC) is, as the maximum molecular weight of main peaks as styrene equivalent, preferably 500 to 100,000, and it is more preferably 3,000 to 100,000, still more preferably 5,000 to 50,000, and particularly preferably 5,000 to 30,000 from the perspective of pigment dispersibility.

When the mass average molecular weight of the dispersant is less than 500, the polarity of the toner composition liquid may be increased to cause a degradation in dispersibility of a colorant used, and when more than 100,000, the affinity for a solvent used may be increased to cause a degradation in dispersibility of a colorant used.

The additive amount of the dispersant is preferably 1 part by mass to 50 parts by mass, and more preferably 5 parts by mass to 30 parts by mass based on 100 parts by mass of a colorant used. When the additive amount is less than 1 part by mass, the dispersability of toner particles may possibly degrade, and when more than 50 parts by mass, the electrostatic property of the toner may possibly degrade.

<Releasing Agent>

In the present invention, the toner composition liquid may contain a wax(s) as releasing agents for the purpose of preventing offset at the time of fixing.

The waxes are not particularly limited and may be suitably selected among from commonly used ones as releasing agents for toner. Examples of the waxes include aliphatic hydrocarbon waxes such as low-molecular weight polyethylene, low-molecular weight polypropylene, polyolefin wax, microcrystalline wax, paraffin wax, and sazole wax; oxides of aliphatic hydrocarbon waxes such as polyethylene oxide waxes or block copolymers thereof; vegetable waxes such as candelilla wax, carnauba wax, Japan tallow, and jojoba wax; animal waxes such as beeswax, lanolin and spermaceti; mineral waxes such as ozokerite, ceresin, and petrolatum; waxes containing aliphatic ester as main component such as montanoic acid ester wax, and caster wax; and waxes such as deoxidized carnauba wax in which the aliphatic ester is partly or fully deoxidized.

Examples of the waxes further include unsaturated straight-chain fatty acids such as palmitic acid, stearic acid, montanoic acid, and straight chain alkyl carboxylic acids containing a straight chain alkyl group; unsaturated fatty acids such as brassidic acid, eleostearic acid, and varinaline acid; saturated alcohols such as stearyl alcohol, eicosyl alcohol, behenyl alcohol, carnaubyl alcohol, ceryl alcohol, melissyl alcohol; polyhydric alcohols such as sorbitol; fatty acid amides such as linoleic acid amide, oleic acid amide, and lauric acid amide; saturated fatty acid bisamides such as methylene bis-capric acid amide, ethylene bis-lauric acid amide, and hexamethylene bis-stearic acid amide; unsaturated fatty acid amides such as ethylene bis-oleic acid amide, hexamethylene bis-oleic acid amide, N,N'-dioleyl adipic acid amide, and N,N'-oleyl sebacic acid amide; aromatic bisamides such as m-xylene bis-stearic acid amide, and N,N'-distearyl isophthalic acid amide; metal salts of fatty acids, such as calcium stearate, calcium laurate, zinc stearate, and magnesium stearate; waxes prepared by grafting a vinyl monomer such as styrene or acrylic acid to an aliphatic hydrocarbon series wax; partial ester compounds between a fatty acid such as behenic acid monoglyceride and a polyhydric alcohol; and methyl ester compounds containing a hydroxyl group, which are obtained by hydrogenizing a plant oil and fat.

Further, the following are preferably exemplified as such: polyolefin obtained by subjecting an olefin to radical polymerization under a high pressure, polyolefin prepared by purifying a low-molecular weight byproduct obtained at the time of polymerizing a high-molecular weight polyolefin, polyolefin polymerized using a catalyst like Ziegler catalyst and metallocene catalyst under a low pressure, polyolefin polymerized utilizing radiation, electromagnetic wave or light, low-molecular weight polyolefin obtained by thermally decomposing a high-molecular weight polyolefin, paraffin wax, microcrystalline wax, Fisher Tropsh wax, synthetic hydrocarbon series wax synthesized by Synthol method, Hydrocol method, or Arge method, synthetic wax prepared by using a compound having one carbon atom as monomer, hydrocarbon series wax having a functional group such as hydroxyl group or carboxyl group, a mixture between a hydrocarbon series wax and a hydrocarbon series wax having a functional group, and graft modified wax grafted with a vinyl monomer such as styrene, maleate, acrylate, methacrylate, or maleic anhydride using each of the above-mentioned waxes as a base.

Furthermore, wax whose molecular weight distribution is made sharp by the press sweating method, solvent method, recrystallization method, vacuum distillation method, supercritical gas extraction method or solution crystallization method; and those where low-molecular weight solid aliphatic acid, low-molecular weight solid alcohol, low-molecular weight solid compound and impurities are removed are preferably used.

The melting point of the wax is preferably 60° C. to 140° C., and more preferably 70° C. to 120° C. in order to keep the blocking resistance and anti-offset property in balance. When the melting point of the wax is lower than 60° C., the blocking resistance may possibly degrade, and when higher than 140° C., the anti-offset property may be hardly exhibited.

In the present invention, a peak top temperature of the maximum peak of endothermic peaks of a wax determined by DSC is to be the melting point of the wax.

In the present invention, as DSC measurement device for the wax or toner, it is preferable to measure the peak top temperature using a differential scanning calorimeter of highly precise, inner-heat input compensation type. The measurement test was conducted according to ASTM D3418-82. For the DSC curve used in the present invention, a DSC curve is used which is measured when the temperature of a wax is once raised and then decreased to previously maintain prehistory records for the wax, subsequently, the temperature of the wax is raised at a temperature increasing rate of 10° C./min.

<Other Components>

The other components are not particularly limited and may be suitably selected in accordance with the intended use. For example, charge controlling agents, external additives, flowability improver, cleanability improver, magnetic material, and metal soap are exemplified.

—Magnetic Material—

For magnetic materials used in the present invention, for example, the following are used: (1) iron oxides such as magnetite, maghemite, and ferrite, and iron oxides containing other metal oxides; (2) metals such as iron, cobalt, and nickel or alloys prepared between these metals and metals such as aluminum, cobalt, copper, lead, magnesium, tin, zinc, antimony, beryllium, bismuth, cadmium, calcium, manganese, selenium, titanium, tungsten and/or vanadium; and (3) mixtures thereof.

Specific examples of the magnetic material include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. These may be used alone in combination. Of these, fine powders of ferrosoferric oxide or $\gamma$-iron sesquioxide are preferably exemplified.

Further, magnetic iron oxides containing different types of elements, such as magnetite, maghemite, and ferrite or mixtures thereof can be used. The different types of elements are selected, for example, from lithium, beryllium, boron, magnesium, aluminum, silicon, phosphorous, germanium, zirconium, tin, sulfur, calcium, scandium, titanium, vanadium, chrome, manganese, cobalt, nickel, copper, zinc, and potassium. The different types of elements may be incorporated in crystal lattice of iron oxide or may be present as oxide or hydroxide on a surface of magnetic iron oxide, and preferably be contained as oxides.

The different types of elements can be incorporated into particles by mixing salts of different type of elements and adjusting the pH of the particles at the time of producing a magnetic material. Further, the different types of elements can be deposited on particle surfaces by adjusting the pH of generated magnetic particles or by adding individual salts of different types of elements and adjusting the pH of the particles.

The use amount of the magnetic material is preferably 10 parts by mass to 200 parts by mass, and more preferably 20 parts by mass to 150 parts by mass based on 100 parts by mass of the binder resins. The number average particle diameter of the magnetic material is preferably 0.1 μm to 2 μm, and more preferably 0.1 μm to 0.5 μm. The number average particle diameter of the magnetic material can be measured by observing a magnified a transmission electron microscope using a digitizer or the like.

For magnetic properties of the magnetic material under application of 10k oersted, it is preferably to use a magnetic material having an anti-magnetic force of 20 oersted to 150 oersted, a saturation magnetization of 50 emu/g to 200 emu/g, and a residual magnetization of 2 emu/g to 20 emu/g.

The magnetic material can also be used as colorant.

—Charge Controlling Agent—

The toner of the present invention may contain a charge controlling agent in accordance with the necessity. The charge controlling agent is not particularly limited and may be suitably selected from among those known in the art. Examples thereof include Nigrosine dyes, triphenylmethane dyes, chrome-containing metal complex dyes, molybdic acid chelate pigments, Rhodamine dyes, alkoxy-based amines, quaternary ammonium salts (including fluorine-modified quaternary ammonium salts), alkylamide, single substance or compounds of phosphorus, single substance or compounds of tungsten, fluorine-based active agents, metal salicylates, and metal salts of salicylic acid derivatives. Specifically, examples of commercially available products of the charge controlling agent include BONTRON 03 (Nigrosine dye), BONTRON P-51 (quaternary ammonium salt), BONTRON S-34 (metal-containing azo dye), BONTRON E-82 (oxynaphthoic acid metal complex), E-84 (salicylic acid metal complex), and E-89 (phenolic condensation product), which are manufactured by Orient Chemical Industries, Ltd.; TP-302 and TP415 (quaternary ammonium salt molybdenum complex), which are manufactured by Hodogaya Chemical Co., LTD.; COPY CHARGE PSY VP2038 (quaternary ammonium salt), COPY BLUE PR (triphenylmethane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments; and polymeric compounds having a functional group such as a sulfonate group, a carboxyl group, or a quaternary ammonium salt group.

The content of the charge controlling agent is determined depending on the type of binder resins used, presence or absence of additives used in accordance with the necessity, and the toner production method including dispersing process and thus is unequivocally defined, however, it is preferably 0.1 parts by mass to 10 parts by mass, and more preferably 0.2 parts by mass to 5 parts by mass. When the content of the charge controlling agent is more than 10 parts by mass, the effect of main charge controlling agent is reduced due to the excessive electrostatic property of the toner, and the electrostatic attraction force to the developing roller used may be increased to cause a degradation in flowability of the developer and a degradation in image density. These charge controlling agents and releasing agents may be fused and kneaded together with the masterbatch and resins or may be added when the binder resins, the colorant and the like are dissolved and dispersed in an organic solvent.

—Flowability Improver—

A flowability improver may be added in the toner of the present invention. The flowability improver is incorporated onto the surface of the toner to improve the flowability.

Examples of the flowability improver include fluorine-based resin powders such as fluorinated vinylidene fine powder and polytetrafluoroethylene fine powder; silica fine powders such as wet-process silica and dry-process silica; titanium oxide fine powder, alumina fine powder, and surface-treated silica powders each of which is prepared by subjecting titanium oxide fine powder or alumina fine powder to a surface treatment with a silane coupling agent, titanium coupling agent or silicone oil, surface-treated titanium oxide, and surface-treated alumina. Of these, silica fine powder, titanium oxide fine powder, and alumina fine powder are preferable. Further, surface-treated silica powders each of which is prepared by subjecting titanium oxide fine powder or alumina fine powder to a surface treatment with a silane coupling agent or silicone oil are still more preferably used.

The particle size of the flowability improver is, as an average primary particle diameter, preferably 0.001 μm to 2 μm, and more preferably 0.002 μm to 0.2 μm.

The silica fine powder is produced by vapor-phase oxidation of a silicon halide compound, is so-called "dry-process silica" or "fumed silica".

As commercially available products of the silica fine powders produced by vapor-phase oxidation of a silicon halide compound, for example, AEROSIL (trade name, manufactured by Japan AEROSIL Inc.) -130, -300, -380, -TT600, -MOX170, -MOX80 and -COK84; CA-O-SIL (trade name, manufactured by CABOT Corp.) -M-5, -MS-7, -MS-75, -HS-5, -EH-5; Wacker HDK (trade name, manufactured by WACKER-CHEMIE GMBH) -N20-V15, -N20E, -T30, and -T40; D-C FINE SILICA (trade name, manufactured by Dow Corning Co., Ltd.); and FRANSOL (trade name, manufactured by Fransil Co.).

Further, a hydrophobized silica fine powder prepared by hydrophobizing a silica fine powder produced by vapor-phase oxidation of a silicon halide compound is more preferable. It is particularly preferable to use a silica fine powder that is hydrophobized such that a hydrophobization degree measured by a methanol titration test is preferably from 30% to 80%. A silica fine powder can be hydrophobized by being chemically or physically treated with an organic silicon compound reactive to or physically absorbed to the silica fine powder, or the like. There is a preferred method, in which a silica fine powder produced by vapor-phase oxidation of a silicon halide compound is hydrophobized with an organic silicone compound.

The organic silicon compound is not particularly limited and may be suitably selected in accordance with the intended use. Examples thereof include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptane, trimethylsilylmercaptane, triorganosilylacrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinytetramethyldisiloxane, 1,3-diphenyltetramethyldisiloxane, and dimethylpolysiloxane having 2 to 12 siloxane units per molecule and having 0 to 1 hydroxy group bonded to Si in the siloxane units positioned at the terminals. Further, silicone oils such as dimethylsilicone oil are exemplified. These organic silicon compounds may be used alone or in combination.

The number average particle diameter of the flowability improver is preferably 5 nm to 100 nm, and more preferably 5 nm to 50 nm.

The specific surface area of fine powder of the flowability improver measured by the BET nitrogen absorption method is preferably 30 $m^2/g$ or more, and more preferably 60 $m^2/g$ to 400 $m^2/g$.

In the case of surface treated fine powder of the flowability improver, the specific surface area is preferably 20 $m^2/g$ or more, and more preferably 40 $m^2/g$ to 300 $m^2/g$.

The use amount of the fine powder is preferably 0.03 parts by mass to 8 parts by mass based on 100 parts by mass of toner particles.

—Cleanability Improver—

As the cleanability improver for improving removability of residual toner remaining on a latent electrostatic image bearing member and a primary transfer member after transferring the toner onto a recording paper sheet or the like, for example, fatty acid metal salts such as zinc stearate, calcium stearate, and stearic acid; and polymer fine particles produced by soap-free emulsion polymerization, such as polymethylmethacrylate fine particles and polystyrene fine particles are exemplified. The polymer fine particles preferably have a relatively narrow particle size distribution and a volume average particle diameter of 0.01 μm to 1 μm.

These flowability improvers, cleanability improvers and the like are used in a state of adhering on or being fixed on the surface of the toner and thus is called "additives". Usually, these improvers are externally added to toner using any of powder mixers such as V-type mixer, rocking mixer, LOEDIGE mixer, NAUTA mixer, HENSCHEL mixer. When these improvers are solidified, any of Hybridizer, Mechanofusion and Q mixer is used, for example.

In the toner composition liquid, the above-mentioned components constituting toner particles are dissolved or dispersed in a solvent, and the solid content of the toner composition liquid is preferably 5% by mass to 40% by mass, and more preferably 7% by mass to 30% by mass. When the solid content of the toner composition liquid is less than 5% by mass, not only the productivity of the toner is decreased but also dispersoids such as pigments, wax fine particles, magnetic material and charge controlling agent easily cause a sedimentation and aggregation, and therefore, the composition for each of toner particles may be readily uneven to degrade the quality of the toner. When the solid content of the toner composition liquid is more than 40% by mass, a toner having small particle diameter may not be obtained and the composition liquid cannot be sprayed due to the degraded sprayability.

The toner of the present invention should have an average circularity of 0.93 to 0.98. When the average circularity is less than 0.93, the transfer rate of toner when a developed toner image is transferred onto paper or the like may decrease, and when more than 0.98, sufficient blade cleanability may not be obtained.

The volume average particle diameter of the toner is preferably 1 μm to 10 μm, and more preferably 2 μm to 8 μm. When the volume average particle diameter is smaller than 1 μm, the developing property and transferability of the toner may degrade, and when greater than 10 μm, it is difficult to excellently reproduce thin lines and dots and thus a high-quality image may not be obtained.

The toner preferably has a particle size distribution (volume average particle diameter/number average particle diameter) of 1.00 to 1.10. When the particle size distribution is greater than 1.10, the amount of such a fine powder having a volume average particle diameter of 10 μm or less, which makes it difficult to perform blade cleaning, is increased, and the blade cleanability may degrade.

The volume average particle diameter (Dv) and the number average particle diameter (Dn) of the toner can be measured by using, for example, a particle size measurement device ("MULTISIZER III", manufactured by Beckman Coulter Inc.) with an aperture diameter of 100 μm.

The toner of the present invention may be mixed with a carrier and used as a two-component developer.

—Carrier—

As to the carrier, typically used carrier such as ferrite and magnetite and resin-coated carrier can be used.

The resin-coated carrier is composed of a coating agent containing core particles and a resin covering surfaces of the core particles.

The resin used in the coating agent is not particularly limited and may be suitably selected in accordance with the intended use. Examples thereof include styrene-acrylic resins such as styrene-acrylic ester copolymers, and styrene-methacrylic ester copolymers; acrylic resins such as acrylic ester copolymers, and methacrylic acid ester copolymers; fluorine-containing resins such as polytetrafluoroethylene, monochlorotrifluoroethylene polymers, and polyvinylidene fluoride; silicone resins, polyester resins, polyamide resins, polyvinyl butyral, and amino acrylate resins. Besides the above mentioned, resins that can be used as coating agents for carrier such as ionomer resins, and polyphenylene sulfide resins are exemplified. These resins may be used alone or in combination.

In addition, it is possible to use a binder type carrier core in which magnetic powder is dispersed in a resin.

As a method of covering the surface of a carrier core with at least a resin-coating agent in the resin-coated carrier, the following methods can be used: a method in which a resin is dissolved or suspended to prepare a coating solution, and the coating solution is applied over a surface of the carrier core so as to be adhered thereon; or a method of mixing a resin in a state of powder, simply.

The mixing ratio of the coating agent to the resin-coated carrier is not particularly limited and may be suitably selected in accordance with the intended use. For example, it is preferably 0.01% by mass to 5% by mass, and more preferably 0.1% by mass to 1% by mass to the resin coated carrier.

For usage examples of coating a magnetic material with two or more types of coating agent, the following are exemplified: (1) coating a magnetic material with 12 parts by mass of a mixture prepared using dimethyldichlorosilane and dimethyl silicon oil based on 100 parts by mass of titanium oxide fine powder at a mass ratio of 1:5; and (2) coating a magnetic material with 20 parts by mass of a mixture prepared using dimethyldichlorosilane and dimethyl silicon oil based on 100 parts by mass of silica fine powder at a mass ratio of 1:5.

Of these resins, a styrene-methyl methacrylate copolymer, a mixture of a fluorine-containing resin and a styrene-based copolymer, or a silicone resins is preferably used. In particular, silicone resin is preferable. Examples of the mixture between a fluorine-containing resin and a styrene-based copolymer include a mixture between polyvinylidene fluoride and a styrene-methyl methacrylate copolymer, a mixture between polytetrafluoroethylene and a styrene-methyl methacrylate copolymer, a mixture of vinylidene fluoride-tetrafluoroethylene copolymer (copolymerization mass ratio=10:90 to 90:10), a mixture of styrene-2-ethylhexyl acrylate copolymer (copolymerization mass ratio=10:90 to 90:10); a mixture of styrene-2-ethylhexyl acrylate-methyl methacrylate copolymer (copolymerization mass ratio=20 to 60:5 to 30:10:50).

For the silicone resin, modified silicone resins produced by reaction of a nitrogen-containing silicone resin and a nitrogen-containing silane coupling agent with a silicone resin are exemplified.

As the magnetic material for carrier core, it is possible to use ferrite, iron-excessively contained ferrite, magnetite, oxide such as γ-iron oxide; or metal such as iron, cobalt, and nickel or an alloy thereof.

Further, examples of elements contained in these magnetic materials include iron, cobalt, nickel, aluminum, copper, lead, magnesium, tin, zinc, antimony, beryllium, bismuth, calcium, manganese, selenium, titanium, tungsten, and vanadium. Of these elements, copper-zinc-iron-based ferrite containing copper, zinc and iron as main components, and manganese-magnesium-iron-based ferrite containing manganese, magnesium, and iron components as main components are particularly preferable.

For the resistance value of the carrier, it is preferable to adjust the degree of convexo-concave of the carrier surface and the amount of resin used for coating a carrier core so as to be $10^6$ Ω-cm to $10^{10}$ Ω-cm.

The particle diameter of the carrier is preferably 4 μm to 200 μm, more preferably 10 μm to 150 μm, and still more preferably 20 μm to 100 μm. In particular, the resin-coated carrier preferably has a $D_{50}$ particle diameter of 20 μm to 70 μm.

In a two-component developer, the use amount of the toner of the present invention is preferably 1 part by mass to 50 parts by mass based on 100 parts by mass of carrier, and more preferably 2 parts by mass to 20 parts by mass based on 100 parts by mass of carrier.

(Method for Producing Toner)

As a means for forming liquid droplets by atomizing the toner composition liquid in a vapor phase, the following are known: a single-fluid spray nozzle (pressurization nozzle) designed to pressurize a liquid to spray it from a nozzle; a multiple-fluid spray nozzle designed to spray a fluid in a state where a liquid and a pressurized gas are mixed; a rotation disc type sprayer designed to form liquid droplets by centrifugal force using a rotating disc. To obtain a toner having small diameter, a multiple-fluid spray nozzle and a rotation disc type sprayer are preferable.

For the multiple-fluid spray nozzle, external mix two-fluid spray nozzles are generally used, however, in order to obtain still further fine particles and uniformity of particle size, various improvements have been made on multiple-fluid spray nozzles, as exemplified by internal mix two-fluid spray nozzles and four-fluid spray nozzles. To obtain the effects similarly to the above, various improvements have been also made on rotation disc type sprayers, as exemplified by those formed into dish-shaped, bowl-shaped, multi-blade shape, and so-forth.

In the present invention, the above-mentioned multiple-fluid spray nozzle or the rotation disc-type sprayer can be used as a droplet forming unit.

However, a toner obtained by any of these production methods has a relatively wide particle size distribution, and classification is sometimes necessary.

In order to solve the shortcomings, the inventors of the present invention found out, as a method of obtaining a toner having a uniform particle size, a method of periodically discharging a toner composition liquid from a thin film having a plurality of nozzles with a uniform nozzle hole diameter by a mechanically vibrating unit to thereby periodically form liquid droplets.

When the method for producing a toner of the present invention is used, it is preferable to employ a method of periodically discharging the above-mentioned toner composition liquid by a mechanically vibrating unit to thereby periodically form liquid droplets.

The use of the mechanically vibrating unit makes it possible to obtain an effect of increasing the degree of irregularization of the shape of toner as compared with the case where a multiple-fluid spray nozzle or a rotation-disc type sprayer is used.

In the toner production method using a mechanically vibrating unit, liquid droplets of a toner composition liquid are formed by mechanically vibrating a thin film having a plurality of nozzles to discharge the toner composition liquid from the nozzles. The mechanically vibrating unit may be set in any position, provided that it vibrates in a perpendicular direction to the thin film having a plurality of nozzles. There are the following two preferred modes.

One mode is to use a mechanical unit (a vertically and mechanically vibrating unit) having a vibrating surface formed in parallel with a thin film having a plurality of nozzles and configured to vibrate perpendicularly to the thin film; and the other mode is to place a mechanically vibrating unit (a circular ring-shaped mechanically vibrating unit)

which is formed in a circular ring shape so as to surround the thin film having a plurality of nozzles.

Hereinbelow, each of the above-noted different types of mechanically vibrating unit will be described in detail.

<Vertically and Mechanically Vibrating Unit>

One example of a toner production apparatus in which a horn type vibrating unit is mounted will be described with reference to the schematic structural view of FIG. 1.

In FIG. 1 a toner production apparatus 1 is equipped with a liquid droplet jetting unit 2 serving as a droplet forming unit configured to form liquid droplets by atomizing a toner composition liquid containing at least two binder resins and a colorant so as to be discharged from the liquid droplet jetting unit; a particle forming section 3 serving as a particle forming unit configured to form toner particles T by solidifying the formed liquid droplets of the toner composition liquid discharged from the liquid droplet jetting unit 2 which is provided on a top surface of the particle forming section 3; a toner collecting unit 4 configured to collect the toner particles T formed in the particle forming section 3; a toner reservoir 6 serving as a toner reserving unit configured to reserve therein the toner particles T that have been collected by the toner collecting unit 4 and are then transferred via a tube 5 thereinto; a material accommodating unit 7 to accommodate a toner composition liquid 10; a liquid sending pipe 8 for sending the toner composition liquid 10 from the material accommodating unit 7 to the liquid droplet jetting unit 2; and a pump 9 for pressure-feeding the toner composition liquid 10 upon operation of the toner production apparatus 1.

The toner composition liquid 10 sent from the material accommodating unit 7 is self-supplied to the liquid droplet jetting unit 2 due to the effect of the liquid droplet forming phenomenon brought by the liquid droplet jetting unit 2, however, as described above, upon operation of the toner production apparatus 1, it is designed to supply liquid using the pump 9 subsidiarily. Note that in this example, as the toner composition liquid 10, a solution or a dispersion liquid is used in which a toner composition liquid containing at least two binder resins and a colorant is dissolved or dispersed in a solvent.

Next, the liquid droplet jetting unit 2 will be described based on FIGS. 2 and 3.

Figure 2:
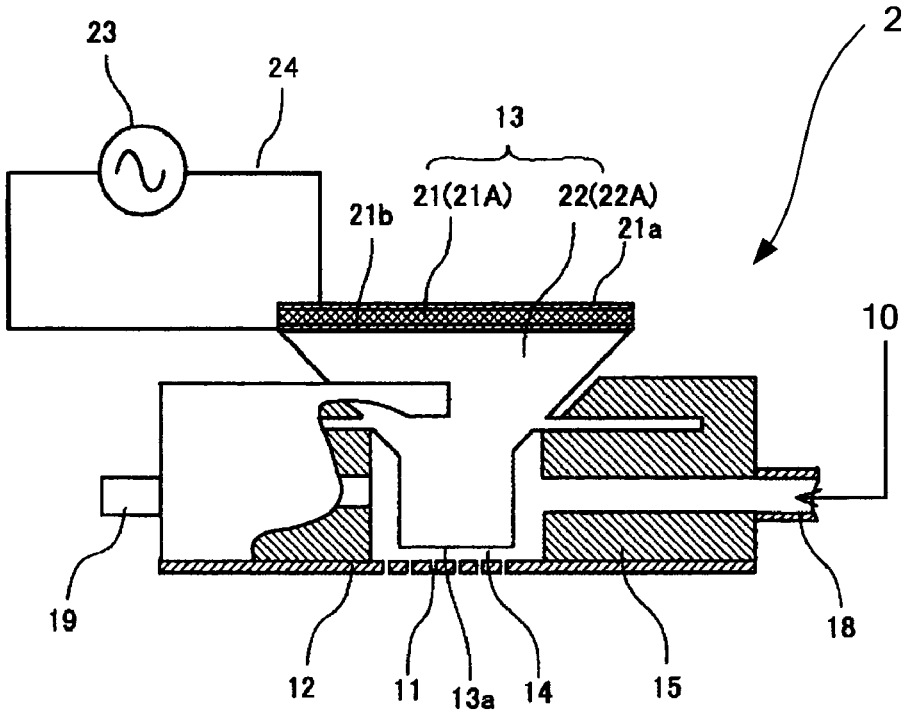
FIG. 2 is an enlarged cross-sectional view explaining the liquid droplet jetting unit mounted in the toner production apparatus shown in FIG. 1.
Figure 3:
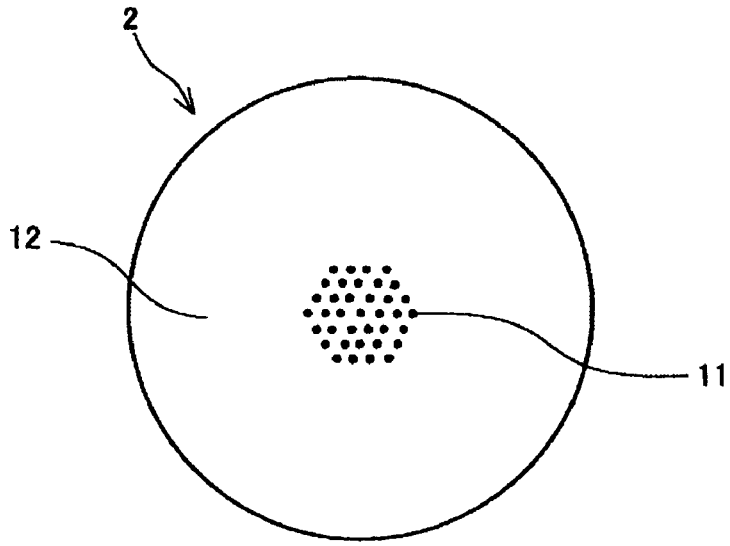
FIG. 3 is a bottom explanatory view of the liquid droplet jetting unit shown in FIG. 2 when viewed from the bottom side.

FIG. 2 is a schematic cross-sectional explanatory view of the liquid droplet jetting unit 2, and FIG. 3 is a bottom explanatory view of the liquid droplet jetting unit shown in FIG. 2 when viewed from the bottom side.

This liquid droplet jetting unit 2 is equipped with a thin film 12 having a plurality of nozzles (ejection ports) 11; a mechanically vibrating unit 13 (hereinafter, referred to as "vibrating unit") configured to vibrate the thin film 12; and a flow passage member 15 forming a reservoir (flow passage) 14 configured to supply the toner composition liquid 10, which contains at least two binder resins and a colorant, in between the thin film 12 and the vibrating-unit 13.

The thin film 12 having a plurality of nozzles 11 is placed in parallel with a vibrating surface 13*a* of the vibrating unit 13 so that part of the thin film 12 is solder-joined or fixed by bonding to the flow passage member 15 with a resin binder that is insoluble in the toner composition liquid 10, and the thin film 12 is set at substantially perpendicularly to the vibrating direction of the vibrating unit 13. A communication unit 24 is provided such that a voltage signal is given to the upper and under surfaces of a vibration generating unit 21 in the vibrating unit 13, and can covert signals received from a drive signal generation source 23 into mechanical vibration. As the communication unit 24 for giving electric signals, a lead wire whose surface is treated by insulating coating is suitable. For the vibrating unit 13, it is advantageous, in order to efficiently and stably producing a toner, to use a device employing a large vibration amplitude such as various types of horn-type vibrator and bolting Langevin transducer.

The vibrating unit 13 is composed of the vibration generating unit 21 configured to generate a vibration, and a vibration amplifying unit 22 configured to amplify the vibration generated by the vibration generating unit 21, in which a drive voltage having a required frequency is applied in between electrodes 21*a* and 21*b* of the vibration generating unit 21 from the drive signal generation source (drive circuit) 23, thereby a vibration is excited in the vibration generating unit 21 and then the vibration is amplified by the vibration amplifying unit 22, the vibrating surface 13*a* placed in parallel with the thin film 12 periodically vibrates, and the thin film 12 vibrates at the required frequency by periodically applied pressure brought by the vibration of the vibrating surface 13*a*.

The vibrating unit 13 is not particularly limited and may be suitably selected in accordance with the intended use, as long as it can assuredly give a vibration with a constant frequency in perpendicularly to the thin film 12. As the vibration generating unit 21, there is a need to vibrate the thin film 12, and therefore a bimorph-type piezoelectric element 21A is preferable, which is capable of exciting flexural oscillation and has a function of converting electric energy into mechanical energy. Specifically, flexural oscillation is excited by application of electric pressure to the piezoelectric element 21A, thereby enabling the thin film 12 to vibrate.

Examples of the piezoelectric element 21A composing the vibration generating unit 21 include piezoelectric ceramics such as lead zirconium titanate (PZT), however, PZT is used in a laminated state because it produces a small amount of displacement. Besides the above-mentioned, piezoelectric polymers such as polyvinylidene fluoride (PVDF), crystals, single crystals such as $LiNbO_3$, $LiTaO_3$, $KNbO_3$ are exemplified.

The vibrating unit 13 may be set in any position as long as capable of giving a vibration in a perpendicular direction to the thin film 12 having nozzles 11, but it is necessary that the vibrating surface 13*a* be placed in parallel with the thin film 12.

In the illustrated example, a horn type vibrator is used as the vibrating unit composed of the vibration generating unit 21 and the vibration amplifying unit 22. Since this horn type vibrator is capable of amplifying the amplitude of a vibration generated from the vibration generating unit 21, such as a piezoelectric element, by means of a horn 22A as the vibration amplifying unit 22, the mechanical vibration itself generated from the vibration generating unit 21 is allowed to be relatively small, which leads to a longer operating life as a production apparatus because the mechanical load can be reduced.

Figure 4:
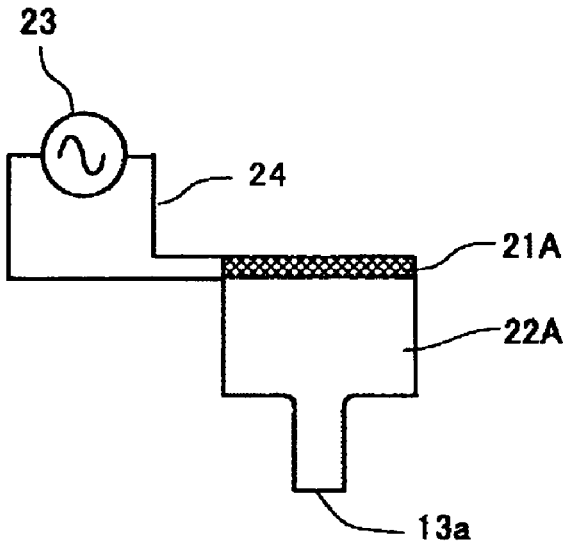
FIG. 4 is an explanatory schematic view exemplarily showing a step-horn vibrator.
Figure 5:
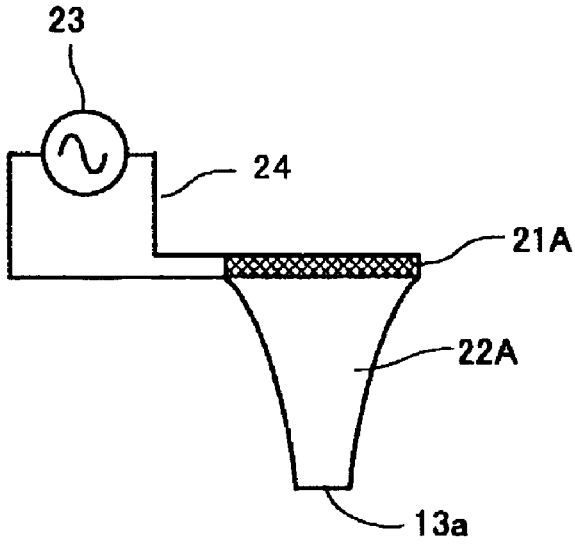
FIG. 5 is an explanatory schematic view exemplarily showing an exponential horn vibrator.
Figure 6:
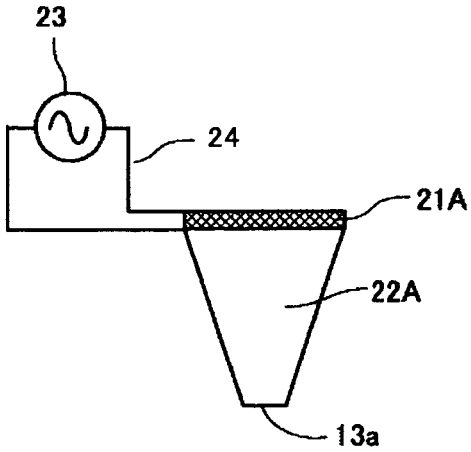
FIG. 6 is an explanatory schematic view exemplarily showing a conical horn vibrator.

As the horn type vibrator, a horn-shaped one generally known in the art may be used. For example, a step-horn vibrator as shown in FIG. 4, an exponential horn vibrator as shown in FIG. 5, and a conical horn vibrator as shown in FIG. 6 are exemplified. In each of these horn type vibrators, a piezoelectric element 21A is set on a surface having a large surface area on a horn 22A and is designed to efficiently induce vibration of the horn 22A by utilizing vertical vibration so that the vibrating surface 13*a*, as a surface having a small surface area provided on the horn 22A, becomes a surface that vibrates at a maximum. At an upper portion and a lower portion of the piezoelectric element 21, a lead wire 24 is provided to give alternating current voltage signals via the drive circuit 23. The shape of the surface vibrating at a maximum of such a horn type vibrator is formed to be a vibrating surface 13*a*.

Further, as the vibrating unit 13, it is also possible to use a bolting Langevin transducer, which has peculiarly high-mechanical resistance. The bonding Langevin transducer will not be broken when a high-amplitude vibration is excited because a piezoelectric ceramics is mechanically connected thereto.

Configurations of the reservoir, the mechanically vibrating unit, and the thin film will be described in detail with reference to the schematic view of FIG. 2. In the reservoir 14 to reserve a toner composition liquid 10, a liquid feed tube 18 is provided at least one site, as shown in the partial cross-sectional view, to introduce a liquid to the reservoir 14 through the flow passage. Further, it is also possible to provide an air bubble discharge tube 19 to the reservoir 14 in accordance with the necessity. The liquid droplet jetting unit 2 is set and held on the top surface of the particle forming section 3 by a support member (not shown) mounted to the flow passage member 15. Note that the toner production apparatus is explained using an example where the liquid droplet jetting unit 2 is placed on the top surface of the particle forming section 3, however, the toner production apparatus may have a configuration where the liquid droplet jetting unit 2 is placed on a side surface wall or the bottom of a drying unit (drying tower) that serves as the particle forming section 3.

The size of the vibrating unit 13 that generates a mechanical vibration is increased, in general, in accordance with a reduction in the number of vibrations generated, and it is possible to directly perforate the vibrating unit 13 to provide a reservoir to the vibrating unit 13 in accordance with the required frequency. Further, it is also possible to vibrate the whole of the reservoir with efficiency.

In this case, "the vibrating surface" is defined as a surface on which the thin film having a plurality nozzles is laminated.

Variant examples of the liquid droplet jetting unit 2 having such a configuration will be explained below with reference to FIGS. 7 and 8.

Figure 7:
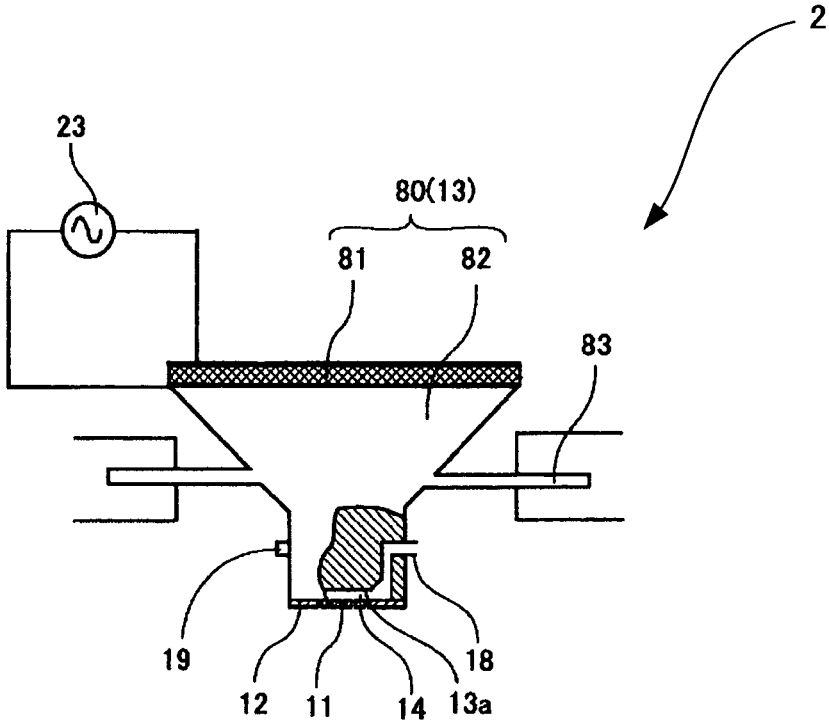
FIG. 7 is an explanatory schematic view showing another example of a liquid droplet jetting unit used in a toner production apparatus.

In an example of the liquid droplet jetting unit shown in FIG. 7, as a vibrating unit 80 (13), a horn vibrator 80 is used, which is composed of a piezoelectric element 81 as a vibration generating unit and a horn 82 as a vibration amplifying unit, and a reservoir (flow passage) 14 is formed at part of the horn 82. This type of liquid droplet jetting unit 2 is preferably fixed on a wall surface of a particle forming section (drying unit or drying tower) 3 by a fixed part (flange part) 83 which is integrally formed with the horn 82 of the horn vibrator 80, and the liquid droplet jetting unit 2 may be fixed using an elastic material (not shown) for the purpose of preventing vibration loss.

Figure 8:
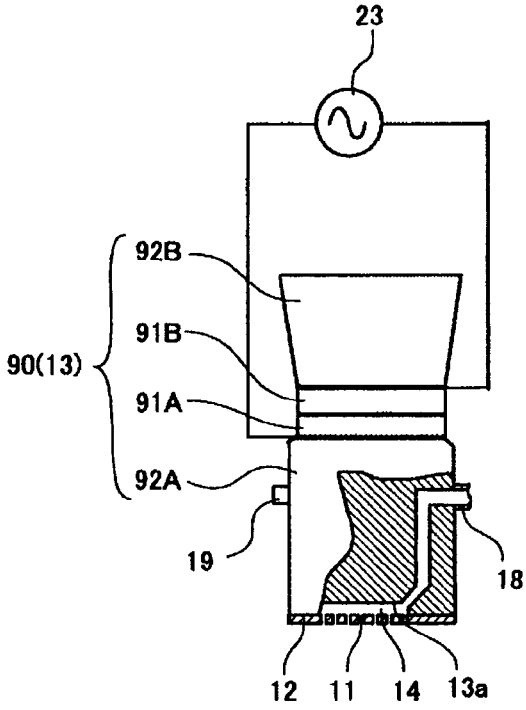
FIG. 8 is an explanatory schematic view showing still another example of a liquid droplet jetting unit used in a toner production apparatus.

In an example of the liquid droplet jetting unit shown in FIG. 8, as a vibrating unit 90 (13), a bolting Langevin vibrator 90 is used, which is composed of piezoelectric elements 91A, 91B serving as vibration generating units and horns 92A and 93B are mechanically and tightly fixed by bolting; and a reservoir (flow passage 14) is formed inside the horn 92A. There is a case where piezoelectric elements are formed large depending on the frequency conditions, and in this case, a fluid introduction/discharge passage and a reservoir are formed and provided to part of the vibrator as shown in the figure, and a metal thin film composed of a plurality of thin films can be attached thereto.

Figure 10:
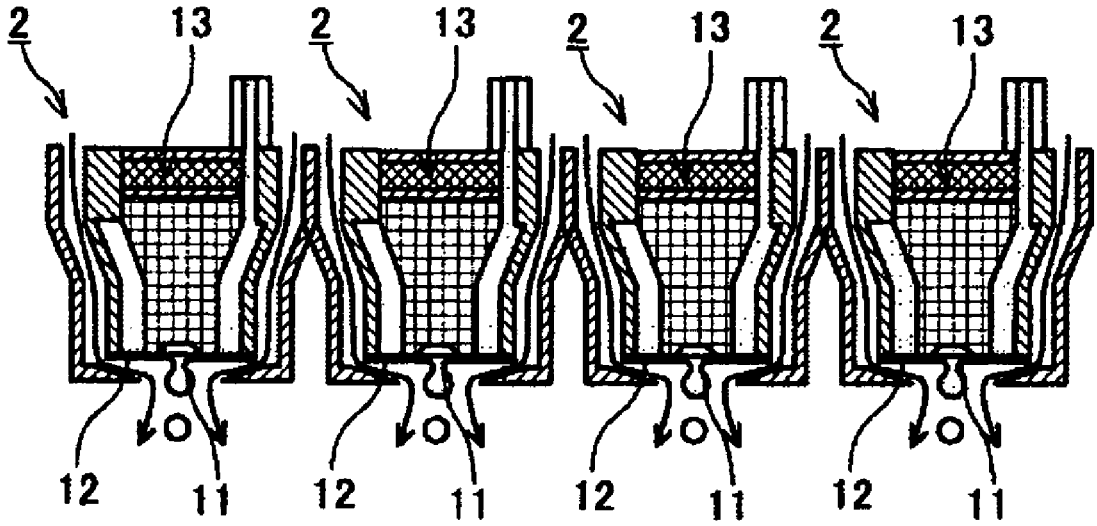
FIG. 10 is an explanatory view showing an instance where a plurality of liquid droplet jetting units each of which is the one shown in FIG. 9 are arranged in a row.

FIG. 1 shows an example in which only one liquid droplet jetting unit 2 is mounted to the particle forming section 3, however, as shown in FIG. 10 to be hereinafter described, it is preferable, from the perspective of improving the productivity, to arrange a plurality of liquid droplet jetting units 2 in parallel on the upper part of the particle forming section 3 (drying unit or drying tower), and the number of liquid droplet jetting units 2 is preferably within the range of 100 to 1,000 from the viewpoint of controllability. In this case, each of the liquid droplet jetting units 2 is designed so that a toner composition liquid 10 is supplied from the material accommodating unit (common liquid reservoir) 7 via the liquid sending pipe 8 to each of reservoirs 14. It may also be designed such that the toner composition liquid 10 is self-supplied or may be designed so as to supply the toner composition liquid 10 using the pump 9 subsidiarily during operation of the toner production apparatus.

Figure 9:
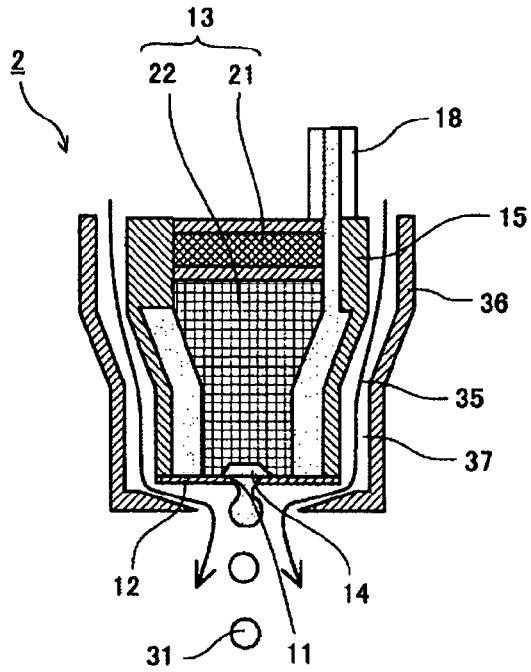
FIG. 9 is an enlarged view explaining yet still another example of a liquid droplet jetting unit used in a toner production apparatus.

Yet still another example of the liquid droplet jetting unit will be described below with reference to FIG. 9. FIG. 9 is a cross-sectional explanatory view exemplarily showing the liquid droplet jetting unit.

In this type liquid droplet jetting unit 2, similarly to the above-mentioned examples, a horn type vibrator is used as a vibration generating unit 13, a flow passage member 15 for supplying a toner composition liquid 10 is set so as to surround the vibration generating unit 13, and a reservoir 14 is formed in a horn 22 of the vibration generating unit 13 at a position oppose to a thin film 12. Further, around the flow passage member 15, an airflow passage forming member 36 is placed so as to form an airflow passage 37 through which an airflow flows, leaving a required space. Note that in FIG. 9, nozzles 11 of the thin film 12 are represented by only one nozzle for the purpose of simplifying the illustration, but a plurality of nozzles are actually provided as described above. Furthermore, as shown in FIG. 10, a plurality of liquid droplet jetting units, for example, in view of the controllability, 100 to 1,000 liquid droplet jetting units are arranged on a top surface of a drying tower (drying unit) composing the particle forming unit 3. With this configuration, the productivity of a toner can be further improved.

<Circular Ring-Shaped Vibrating Unit>

Figure 11:
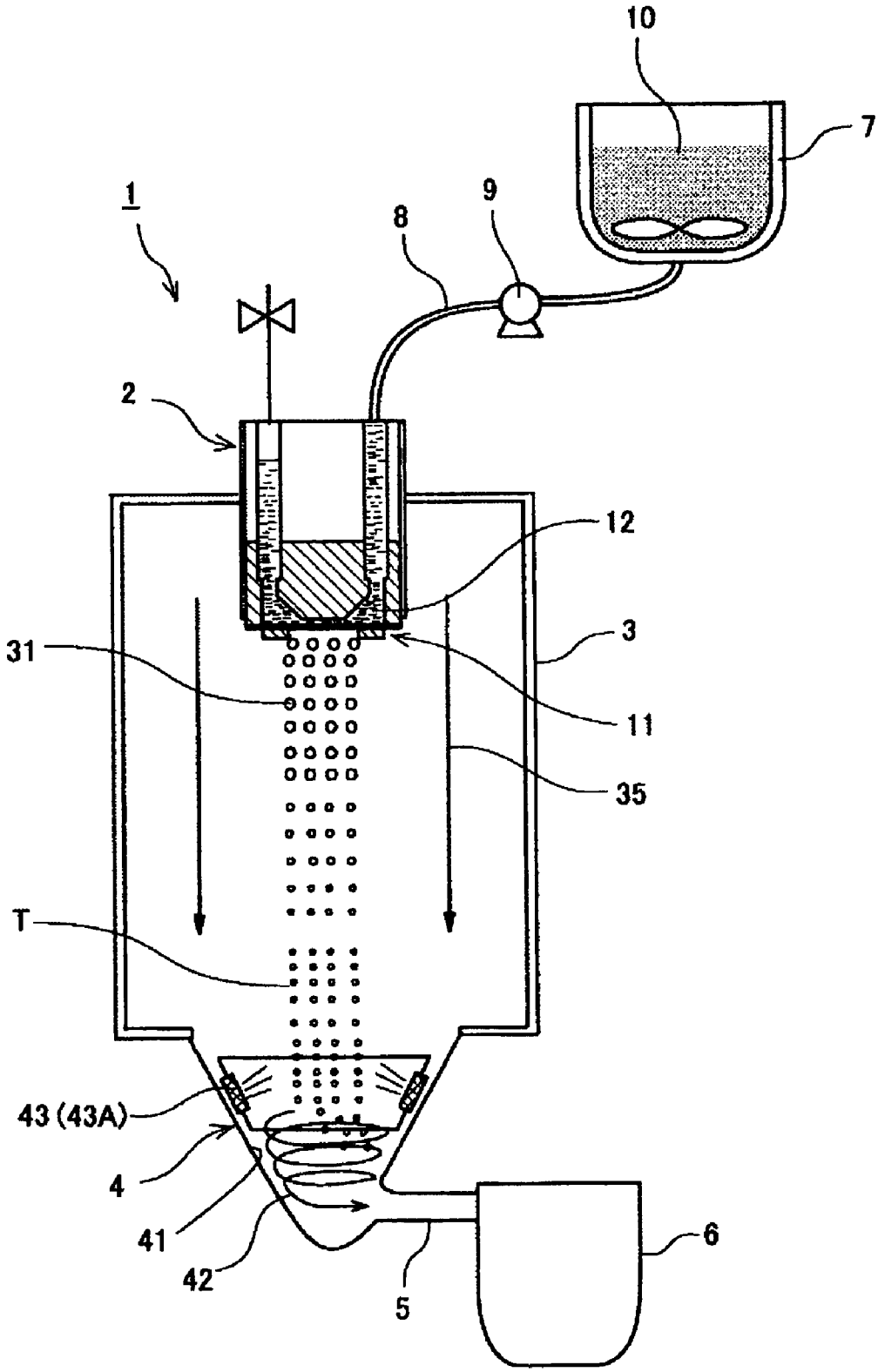
FIG. 11 is a schematic structural view showing another example of a toner production apparatus with which a method for producing a toner of the present invention is used.

In FIG. 11, a ring-shaped liquid droplet jetting unit is used in the toner production apparatus shown in FIG. 1.

Figure 13:
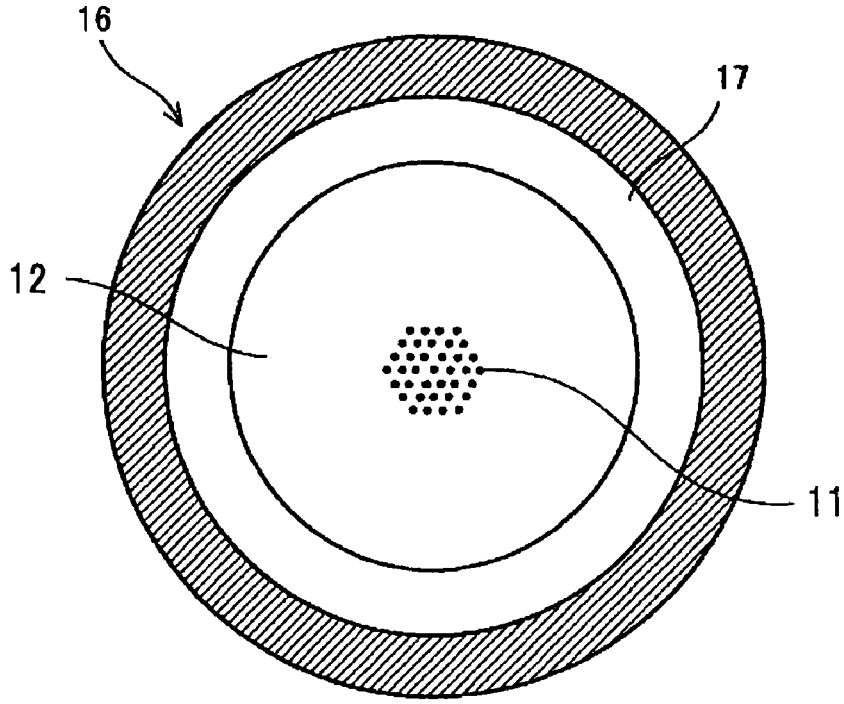
FIG. 13 is a bottom explanatory view of the liquid droplet jetting unit shown in FIG. 12 when viewed from the bottom side.
Figure 14:
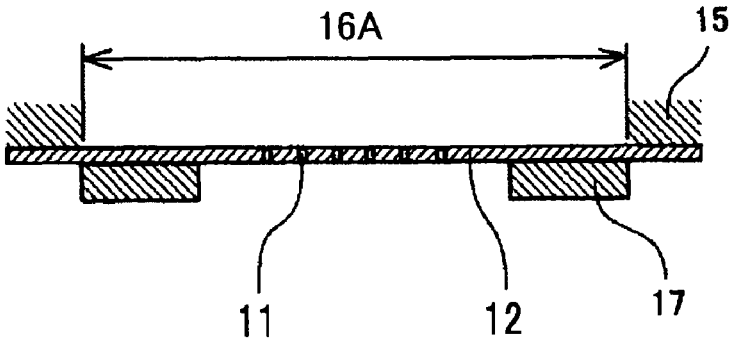
FIG. 14 is an enlarged cross-sectional explanatory view showing a droplet forming unit as a liquid droplet jetting unit.

Hereinafter, a ring-shaped liquid droplet jetting unit 2 will be explained with reference to FIGS. 12 to 14.

Figure 12:
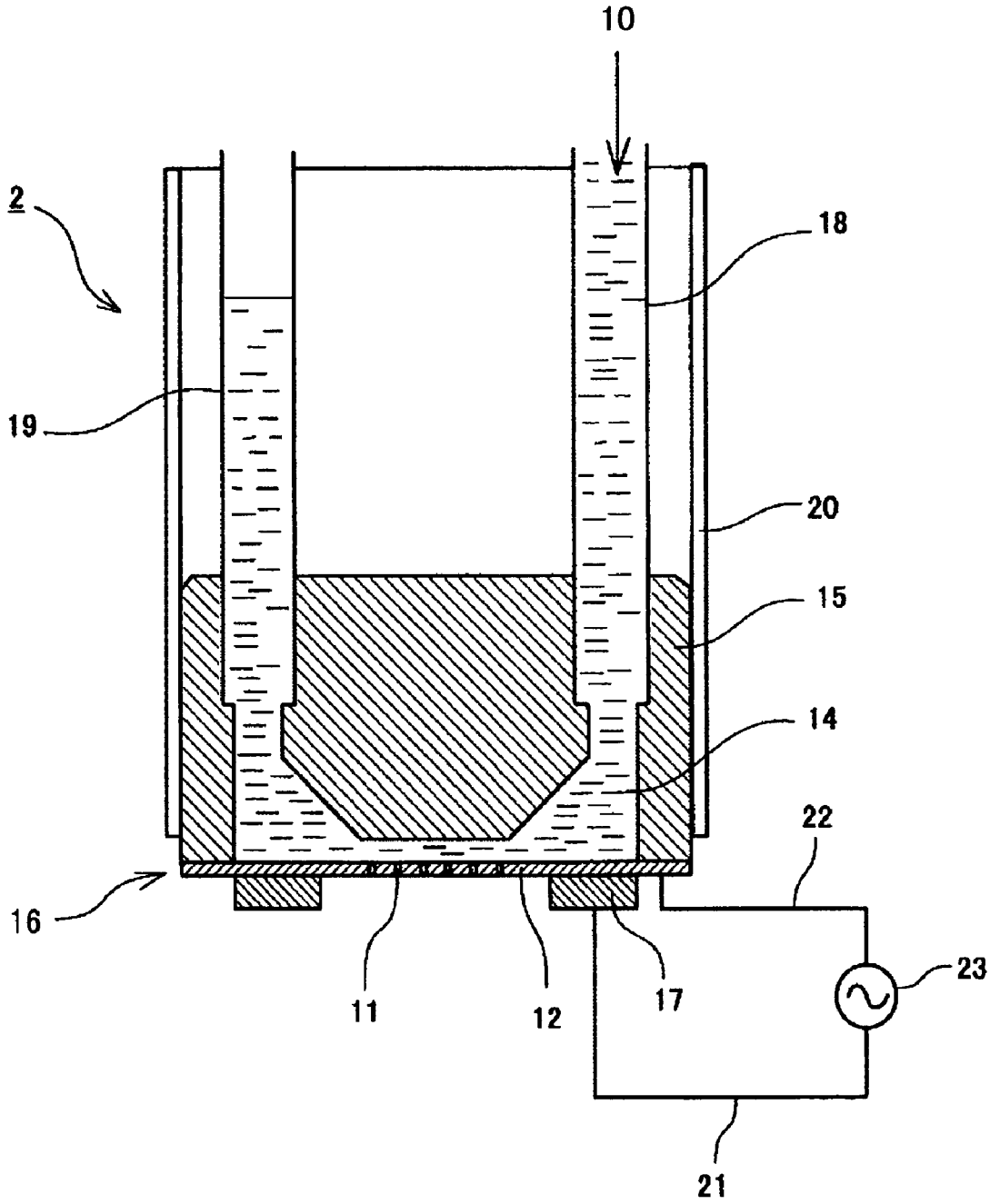
FIG. 12 is an enlarged cross-sectional view for explaining a liquid droplet jetting unit mounted in the toner production apparatus shown in FIG. 11.

FIG. 12 is an enlarged cross-sectional view of the same liquid droplet jetting unit 2. FIG. 13 is a bottom explanatory view of the liquid droplet jetting unit shown in FIG. 12 when viewed from the bottom side. FIG. 14 is an enlarged cross-sectional explanatory view schematically showing a droplet forming unit.

The liquid droplet jetting unit 2 is equipped with a droplet forming unit 16 configured to form liquid droplets by atomizing a toner composition liquid 10 containing at least two binder resins and a colorant to discharge liquid droplets, and a flow passage member 15 forming a reservoir (flow passage) 14 for supplying a toner composition liquid 10 to the liquid droplet forming unit 16.

The liquid droplet forming unit 16 is composed of a thin film 12 in which a plurality of nozzles (ejection ports) 11 are formed, and a circular-ring shaped vibration generating unit (electrical-mechanical converting unit) 17 configured to vibrates the thin film 12. In this embodiment, the outermost circumferential portion (shaded area in FIG. 14) of the thin film 12 is connected to the flow passage member 15 by soldering or with a resin binder material insoluble in the toner composition liquid 10 so as to be fixed. The vibration generating unit 17 is positioned about a periphery within a deformable area 16A (area unfixed to the flow passage member 15) of the thin film 12. A drive voltage (drive signal) having a required frequency is applied from a drive circuit (drive signal source) 23 to the vibration generating unit 17 via lead wires 21 and 22 to thereby generate, for example, a flexural vibration.

Figure 15:
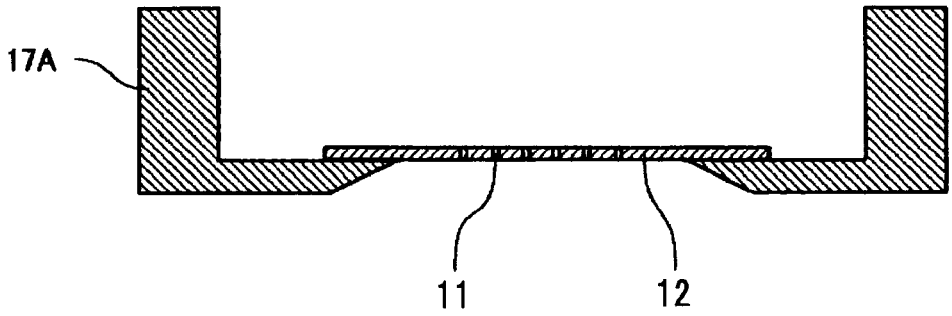
FIG. 15 is an enlarged cross-sectional explanatory view of a droplet forming unit according to the structure of Comparative Examples.

In the droplet forming unit 16, the circular-ring shaped vibration generating unit 17 is placed about the periphery of within the deformable area 16A of the thin film 12 where the plurality of nozzles 11 are arranged so as to face the reservoir 14, thereby the displacement of the thin film 12 becomes relatively large, as compared to the configuration used in Comparative Examples as shown in FIG. 15, for instance, where the periphery of the thin film 12 is held by the vibration generating unit 17A. Thus, the plurality of nozzles 11 can be arranged in the area having a relatively large surface area (a diameter of 1 mm or more) by which such a large displacement can be obtained, and therefore a large amount of liquid droplets can be stably formed and discharged from the plurality of nozzles 11 at a time.

Figure 16:
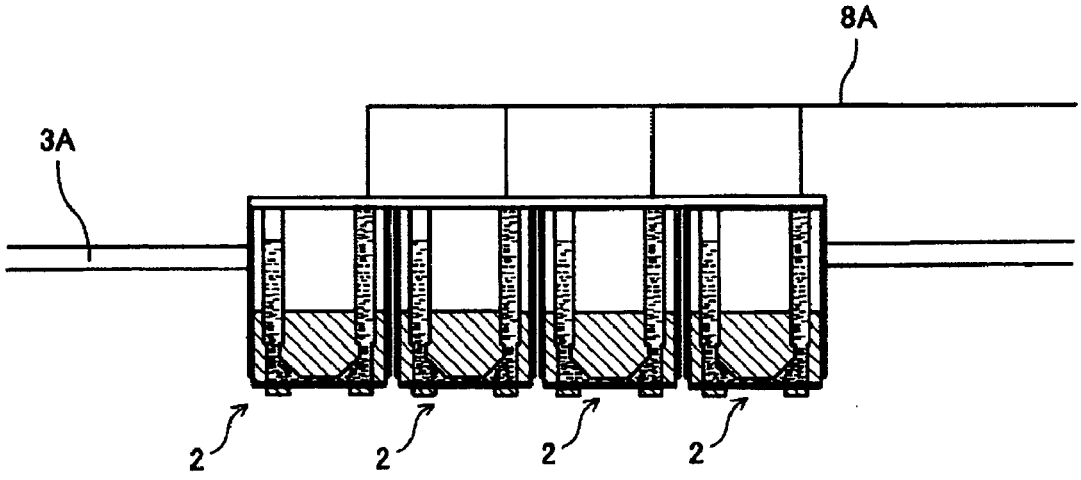
FIG. 16 is an explanatory view showing essential elements of a toner production apparatus for explaining a specific use thereof.

FIG. 11 shows an example where only one liquid droplet jetting unit 2 is placed, however, as shown in FIG. 16, it is preferable that a plurality of liquid droplet jetting units 2, from the perspective of the controllability, for example, 100 to 1,000 liquid droplet jetting units 2 (in FIG. 16, only four units are illustrated) are arranged on a top surface 3A of the particle forming unit 3, and a liquid sending pipe 8A is connected from a material accommodating unit 7 (common reservoir) to each of the liquid droplet jetting units 2 to thereby supply the toner composition liquid 10 to each of the liquid droplet jetting units 2. With this configuration, a large amount of liquid droplets can be discharged at a time and the production efficiency can be improved.

<Mechanism of Formation of Liquid Droplets>

Hereinafter, a mechanism of formation of liquid droplets based on the liquid droplet jetting unit 2 as a liquid droplet forming unit will be described.

As described above, each of the liquid droplet jetting units 2 is configured to propagate a vibration generated by the vibration unit 13 as a mechanically vibrating unit to the thin film 12 having the plurality of nozzles 11 facing the reservoir 14 to periodically vibrate the thin film 12 and to stably form and discharge liquid droplets from the plurality of nozzles 11, which are arranged within an area having a relatively large surface area (diameter: 1 mm or more).

Figure 17:
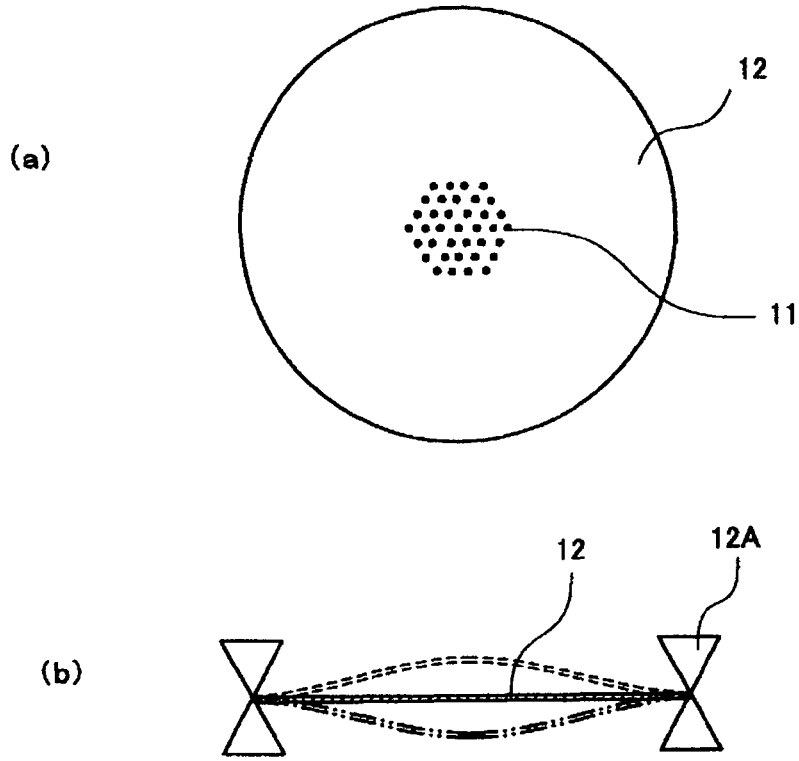
FIG. 17 is an explanatory schematic view for explaining the principle of operations of forming liquid droplets through the use of a liquid droplet jetting unit.
Figure 18:
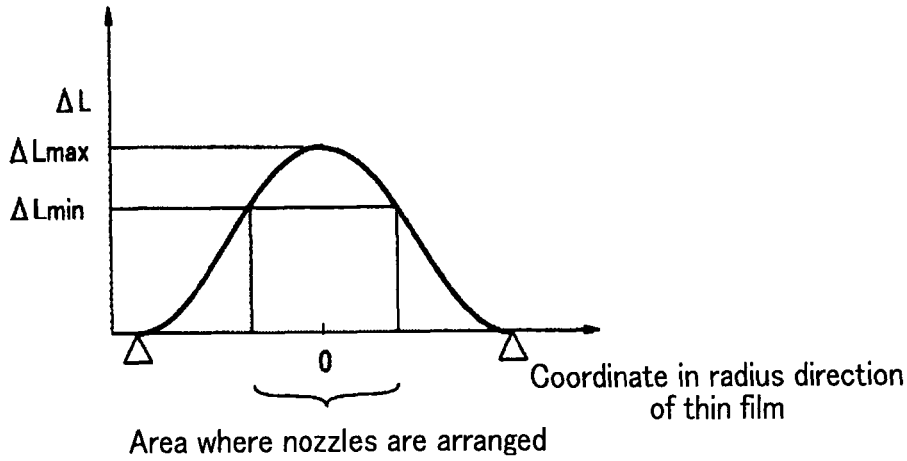
FIG. 18 is an explanatory view for explaining a basic vibration mode.

When a periphery 12A of a simple round-shape film 12 as shown in FIG. 17 is fixed, the periphery 12A becomes a node of the basic vibration, and as shown in FIG. 18, it has a cross-sectional shape in which a vibration displacement ΔL is a maximum value at a center "0" of the thin film 12 (ΔLmax) and periodically vibrates up and down in the vibration direction.

Figure 19:
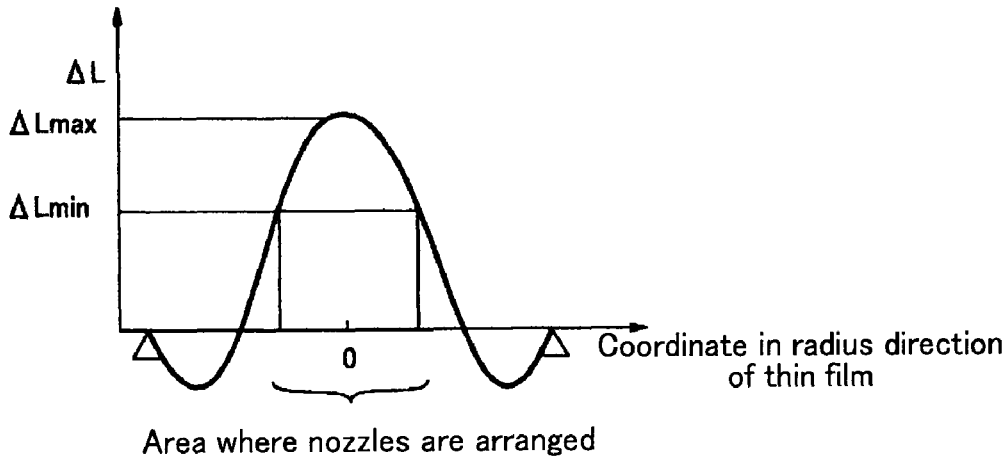
FIG. 19 is an explanatory view for explaining a secondary vibration mode.
Figure 20:
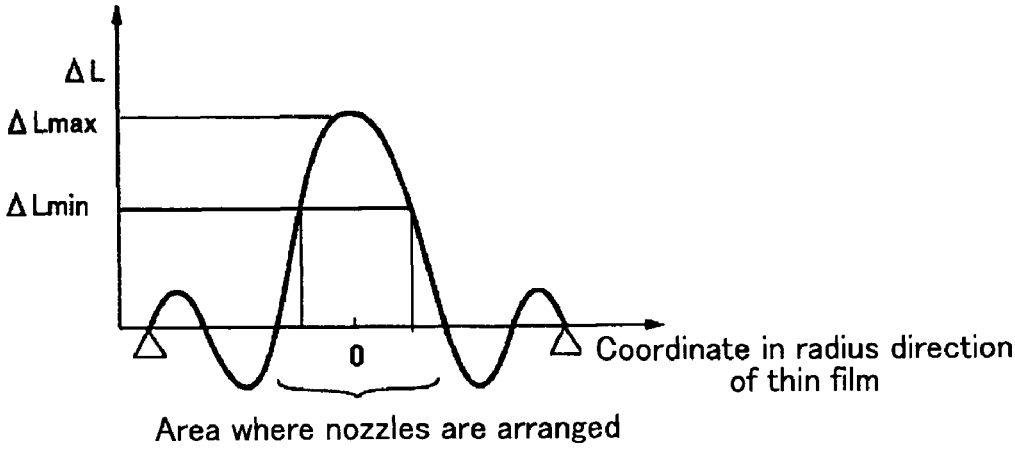
FIG. 20 is an explanatory view for explaining a third vibration mode.
Figure 21:
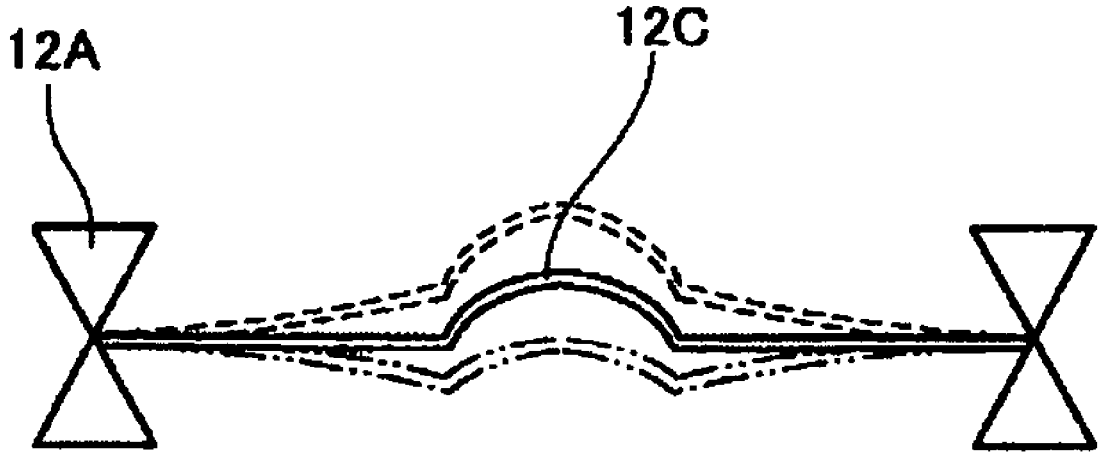
FIG. 21 is an explanatory view for explaining an instance where a convex portion is formed at a center of a thin film.

Further, it is known that there are more highly advanced modes as shown in FIGS. 19 and 20. Each of these modes has one node or plural nodes in concentric form within its round shape film and has a deformed shape in substantially axial symmetry. Furthermore, as shown in FIG. 21, by making a center portion have a convex 12*c*, it is possible to control the moving direction of liquid droplets and to adjust the amplitude of vibration.

In a liquid near the nozzles provided at individual positions in the round-shape thin film, a sound pressure "$P_{ac}$" proportional to a vibration speed "$V_m$" of the thin film is generated by the vibration of the round-shape thin film. It has been known that the sound pressure arises as a reaction of a radiation impedance "$Z_r$" of a medium (toner composition liquid). The sound pressure is expressed by multiplying a radiation impedance by a vibration speed of film "$V_m$", as shown in the following Equation (1).

$$P_{ac}(r,t)=Z_r\times V_m(r,t) \quad \text{Equation (1)}$$

Since the vibration speed "$V_m$" of the film periodically varies with time, it is a function calculating a cycle time. For example, it is possible to form various cyclic variations such as a sine waveform, and a rectangular waveform. As described above, the vibration displacement in the vibration direction differs in individual positions of the film, and the vibration speed "$V_m$" is also a function calculating a position coordinate on the film. The vibration form of a film used in the present invention is axial symmetry, as mentioned above. Thus, the vibration form is virtually a function of a radial coordinate.

As described above, a sound pressure arises in proportion to a speed of vibration displacement of a film having a distribution as explained above, and a toner composition liquid is ejected to a vapor phase in accordance with a periodic change in the sound pressure.

The toner composition liquid periodically ejected to the vapor phase is formed in a spherical shape due to a difference in surface tension between the liquid phase and the vapor phase, and therefore a phenomenon of liquid droplet formation periodically arises.

As a vibration frequency of the film enabling the formation of liquid droplets, it is within the range of 20 kHz to 2.0 MHz, and preferably within the range of 50 kHz to 500 kHz. With the use of a vibration cycle of 20 kHz or more, dispersion of fine particles of pigment, wax and the like in the toner composition liquid is accelerated.

Further, when the sound pressure displacement is 10 kPa or more, the effect of accelerating dispersion of fine particles is exerted with more efficiency.

There is a tendency that the greater the vibration displacement of liquid droplets near the nozzles formed on the film the larger the diameter of liquid droplets formed, and when the vibration displacement is small, small liquid droplets are formed, or liquid droplets are not formed. To reduce variations in size of liquid droplets at each of nozzle portions, it is necessary to define an appropriate arrangement of the nozzles so as to obtain an optimum vibration displacement of the film.

In the present invention, as explained in FIGS. 18 to 20, it was found that variations in size of liquid droplets can be kept within a range required for forming toner fine particles capable of providing high-quality images by disposing nozzles at such positions that a ratio "R" ($=\Delta L_{max}/\Delta L_{min}$) of a maximum value $\Delta L_{max}$ to a minimum value $L_{min}$ of vibration displacement in the vibration direction of the film near the nozzles, generated by the mechanically vibrating unit, is within 2.0.

As a result of changing the conditions for a toner composition liquid, it was found that a range of conditions where a viscosity is set to 20 mPa·s or less, a surface tension was set to 20 mN/m to 75 mN/m is similar to a range of conditions where a satellite begins to take place. The term "satellite" means liquid droplets having apparently smaller diameters than those of the liquid droplets that can be obtained under normal circumstances. When the vibration displacement is greater than a vibration displacement with which liquid droplets having target diameters can be produced, small liquid droplets may be generated in association with main liquid droplets, and the produced small liquid droplets are called "satellite". Note that when the vibration displacement is smaller than the vibration displacement with which liquid droplets having target diameters can be produced, liquid droplets having diameters smaller than the target diameters are also produced, and such small liquid droplets are also called "satellite". Based on the findings, it was recognized that the variation in sound pressure needs to be 500 kPa or lower, and more preferably 100 kPa or lower.

<Thin Film Having a Plurality of Nozzles>

The thin film having a plurality of nozzles is, as described above, a member for ejecting a solution or dispersion liquid of toner material to form liquid droplets.

With respect to the material of the thin film 12, and the shape of the nozzles 11, they are not particularly limited and may be suitably selected in accordance with the intended use. For example, it is preferable that the thin film 12 be formed of a metal plate having a thickness of 5 μm to 500 μm and the nozzles 11 respectively have a hole diameter of 3 μm to 35 μm, from the perspective of generating microscopic liquid droplets having extremely uniform particle size when liquid droplets of the toner composition liquid 10 are ejected from the nozzles 11. Note that when the nozzle holes are respectively formed in perfect circle, the hole diameter of the nozzles 11 means a diameter, and when the nozzle holes are respectively formed in ellipsoidal shape, it means a minor axis. The number of nozzles 11 is preferably from 2 to 3,000.

—Drying—

The drying of liquid droplets to remove a solvent used from the formed liquid droplets is carried out by discharging the liquid droplets in a gas such as heated dry nitrogen gas. When necessary, secondary drying such as fluidized-bed drying and vacuum drying is carried out.

In image developing processes using the toner of the present invention, all of conventional latent electrostatic image bearing members used in electrophotography can be used, however, organic latent electrostatic image bearing members, amorphous-silica latent electrostatic image bearing members, selenium latent electrostatic image bearing members, zinc-oxide latent electrostatic image bearing members and the like are suitably used.

EXAMPLES

Hereinafter, the present invention will be further described in detail referring to specific Examples, but it will be understood that the present invention is not construed as being limited thereto.

Example 1

Preparation of Colorant Dispersion Liquid

First, as a colorant, a dispersion liquid of carbon black was prepared.

Specifically, 17 parts by mass of carbon black (REGAL 400, manufactured by Cabot Corp.) and 3 parts by mass of a pigment dispersant were added to 80 parts by mass of ethyl acetate and primarily dispersed using a mixer having stirring blades to obtain a primary dispersion liquid. As the pigment dispersant, AJISPER PB821 (manufactured by Ajinomoto Fine-Techno Co., Inc.) was used. The obtained primary dispersion liquid was finely dispersed under strong shearing force using a DYNO MILL to prepare a second dispersion liquid where aggregates of 5 μm or more in size were completely removed.

—Preparation of Wax Dispersion Liquid—

Next, a wax dispersion liquid was prepared.

Specifically, 18 parts by mass of a carnauba wax and 2 parts by mass of a wax dispersant were added to 80 parts by mass of ethyl acetate and primarily dispersed using a mixer having stirring blades to prepare a primary dispersion liquid. The primary dispersion liquid was heated to 80° C. with stirring to dissolve the carnauba wax therein, and then the temperature of the primary dispersion liquid was decreased to room temperature to precipitate wax particles such that a maximum diameter became 3 μm or less. As the wax dispersant, the one prepared by grafting a styrene-butyl acrylate copolymer on a polyethylene wax was used. The obtained dispersion liquid was further finely dispersed under strong shearing force using a DYNO MILL so as to prepare a wax dispersion liquid having a maximum diameter of 2 μm or less.

—Preparation of Toner Composition Dispersion Liquid—

Next, the resins described below as binder resins, the colorant dispersion liquid, and the wax dispersion liquid were agitated and uniformly dispersed for 10 minutes using a mixer having stirring blades to prepare a toner composition dispersion liquid having a solid content of 15% by mass.

| | |
|---|---|
| ethyl acetate solution having a solid content of 20% by mass composed of a polyester resin | 325 parts by mass |
| ethyl acetate solution having a solid content of 20% by mass composed of a styrene-n-butyl acrylate copolymer resin | 108 parts by mass |
| colorant dispersion liquid | 42 parts by mass |
| wax dispersion liquid | 25 parts by mass |
| ethyl acetate | 167 parts by mass |

The mass average molecular mass of the polyester resin was 61,000, and the glass transition temperature was 60° C. The mass average molecular mass of the styrene-n-butyl acrylate copolymer resin was 55,000, and the glass transition temperature was 61° C.

Note that 325 parts by mass of the ethyl acetate solution having a solid content of 20% by mass composed of a polyester resin and 108 parts by mass of the ethyl acetate solution having a solid content of 20% by mass composed of a styrene-n-butyl acrylate copolymer resin were mixed, the mixture solution was applied onto a transparent PET film using a wire bar, and dried, thereafter, it was confirmed that the coat film became white turbid and these resins were incompatible with each other.

—Preparation of Toner—

The obtained toner composition dispersion liquid was sprayed into nitrogen gas (45° C.) at an air pressure of 0.1 MPa using a two-fluid spray nozzle, liquid droplets were collected with the use of a cyclone, thereafter, dried at 40° C. with air blasting for 3 days, and black fine particles were thus obtained.

Further, the black fine particles were subjected to fine powder classification by a wind classifier, and 1.0% by mass of hydrophobized silica (H2000, manufactured by Clariant Japan K.K.) was externally added to the black fine particles using a HENSCHEL MIXER (manufactured by MITSUI MINING CO., LTD.) to thereby produce a "black toner a".

For the obtained "black toner a", the average circularity, a volume average particle diameter Dv and a Dv/Dn ratio of the volume average particle diameter Dv to a number average particle diameter Dn were measured as follows. As a result, it was recognized that the "black toner a" had an average circularity of 0.98, and a volume average particle diameter Dv of 5.9 μm, and the Dv/Dn ratio of the volume average particle diameter Dv a the number average particle diameter Dn measured was 1.28. Table 1 shows the measurement results.

<Average Circularity>

The average circularity of each of the toners was measured by means of a flow particle image analyzer FPIA-2000 (manufactured by SYSMEX Corp.). Specifically, in a vessel, into 100 mL to 150 mL of water from which impure solid products had been removed beforehand, 0.1 mL to 0.5 mL of a surfactant (alkylbenzene sulfonate) was added as a dispersant, and then approximately 0.1 g to 0.5 g of each of measurement samples was further added thereto, and a suspension with the sample dispersed therein was dispersed for 1 minute to 3 minutes with the use of a ultrasonic dispersing device such that the concentration of the dispersion liquid was 3,000/μL to 10,000/μL. Thereafter, the shape and the particle size distribution of each of the toners were measured to determine an average circularity.

<Volume Average Particle Diameter and Particle Size Distribution>

The volume average particle diameter (Dv) and the number average particle diameter (Dn) of each of the toners were measured by means of a particle size measurement device ("MULTISIZER III" manufactured by Beckman Coulter Co.) with an aperture diameter of 100 μm, and analyzed by analysis software (BECKMAN COULTER MULTISIZER 3 VERSION 3.51).

Specifically, in a 100 mL glass beaker, 0.5 mL of 10% by mass surfactant (alkylbenzene sulfonate, SC-A, manufactured by Dai-ichi Kogyo Seiyaku Co., Ltd.) was added, and 0.5 g of each of the toners was added, and mixed with the use of a micro-spatula. Next, 80 mL of ion exchange water was added thereto. The obtained dispersion liquid was dispersed for 10 minutes by means of an ultrasonic dispersing device (W-113MK-II, manufactured by HONDA ELECTRONICS CO., LTD.). The volume average particle diameter and the particle size distribution of each of the dispersion liquids were measured with the use of the MULTISIZER III using ISOTON III (manufactured by manufactured by Beckman Coulter Co.) as a solution for measurement. Based on the obtained particle size distribution, the volume average particle diameter (Dv) and the number average particle size (Dn) can be determined. As an index of particle size distribution, a Dv/Dn ratio, which is obtained by dividing a volume average particle diameter (Dv) of each toner by a number average particle diameter (Dn), can be used. If the solution for measurement is completely monodispersed, the Dv/Dn ratio is equal to 1, and the greater the Dv/Dn value, the wider the particle size distribution.

—Preparation of Carrier—

| | |
|---|---|
| silicone resin (organo straight silicone) | 100 parts by mass |
| toluene | 100 parts by mass |
| γ-(2-aminoethyl)aminopropyl trimethoxysilane | 5 parts by mass |
| carbon black | 10 parts by mass |

The above-mentioned components were mixed to prepare a mixture, the mixture was dispersed for 20 minutes using a homomixer to prepare a coat layer forming solution. The coat layer forming solution was applied over the surface of 1,000 parts by mass of spherical magnetite particles having a particle diameter of 50 μm using a fluidized bed type coater to thereby obtain a magnetic carrier A.

—Preparation of Developer—

In a ball mill, 96 parts by mass of the magnetic carrier A were mixed with 4 parts by mass of the "toner a" to prepare a two-component developer.

Example 2

A "black toner b" and a developer were prepared in a similar manner to Example 1, except that the two-fluid spray nozzle was changed to a rotation disc type nozzle.

The obtained black toner b had an average circularity of 0.97 and a volume average particle diameter Dv of 5.8 μm; and the Dv/Dn ratio of the volume average particle diameter Dv to a number average particle diameter Dn measured was 1.23. Note that these values were measured in the same manner as in Example 1. Table 1 shows the measurement result.

Example 3

A "black toner c" and a developer were prepared in a similar manner to Example 1, except that the two-fluid spray nozzle was changed to a toner production apparatus as shown in FIG. 11 (a mechanically vibrating unit is formed in a circular ring shape so as to surround a thin film having a plurality of nozzles with a uniform diameter).

The obtained black toner c had an average circularity of 0.96 and a volume average particle diameter Dv of 5.1 μm; and the Dv/Dn ratio of the volume average particle diameter Dv to a number average particle diameter Dn measured was 1.09. Note that these values were measured in the same manner as in Example 1. The degree of irregularization of the shape of the black toner c was greater than those of Examples 1 and 2. Table 1 shows the measurement result.

It should be noted that the thin film used was prepared by electrocasting ejection holes (nozzles) each formed in a perfect circle and having a diameter of 8 μm, on a nickel plate of 8.0 mm in external diameter and 20 μm in thickness; the ejection holes were provided to only an area having a diameter of 5 mm from a center of the thin film, like in a hound-tooth check pattern, such that the distance between each of the ejection holes was 100 μm.

As a piezoelectric element, lead zirconate titanate (PZT) was formed in a laminate for use, and the vibration frequency was adjusted to 100 kHz.

Example 4

A "black toner d" and a developer were prepared in a similar manner to Example 1, except that the two-fluid spray nozzle was changed to a toner production apparatus as shown in FIG. 1 (a mechanically vibrating unit based on a mode where a parallel vibrating surface vertically vibrates in a perpendicular direction to a thin film having a plurality of nozzles with a uniform diameter).

The obtained black toner d had an average circularity of 0.96 and a volume average particle diameter Dv of 4.8 μm; and the Dv/Dn ratio of the volume average particle diameter Dv to a number average particle diameter Dn measured was 1.05. Note that these values were measured in the same manner as in Example 1. The degree of irregularization of the shape of the black toner d was greater than those of Examples 1 and 2. Table 1 shows the measurement result.

It should be noted that the thin film used was prepared by electrocasting ejection holes (nozzles) each formed in a perfect circle and having a diameter of 8 μm, on a nickel plate of 8.0 mm in external diameter and 20 μm in thickness; the ejection holes were provided to only an area having a diameter of 5 mm from a center of the thin film, like in a hound-tooth check pattern, such that the distance between each of the ejection holes was 100 μm.

As a piezoelectric element, lead zirconate titanate (PZT) was formed in a laminate for use, and the vibration frequency was adjusted to 180 kHz.

Example 5

A "black toner e" and a developer were prepared in a similar manner to Example 4, except that the amount of the toner composition dispersion liquid formulated was changed to the following values, and the solid content was changed to 5% by mass.

The obtained black toner e had an average circularity of 0.95 and a volume average particle diameter Dv of 3.9 μm; and the Dv/Dn ratio of the volume average particle diameter Dv to a number average particle diameter Dn measured was 1.04. Note that these values were measured in the same manner as in Example 1. Table 1 shows the measurement result.

| | |
|---|---|
| ethyl acetate solution having a solid content of 20% by mass composed of a polyester resin | 325 parts by mass |
| ethyl acetate solution having a solid content of 20% by mass composed of a styrene-n-butyl acrylate copolymer resin | 108 parts by mass |
| colorant dispersion liquid | 42 parts by mass |
| wax dispersion liquid | 25 parts by mass |
| ethyl acetate | 1,500 parts by mass |

Example 6

A "black toner f" and a developer were prepared in a similar manner to Example 4, except that the amount of the toner composition dispersion liquid formulated was changed to the following values, and the solid content was changed to 40% by mass.

The obtained black toner f had an average circularity of 0.97 and a volume average particle diameter Dv of 6.8 μm; and the Dv/Dn ratio of the volume average particle diameter Dv to a number average particle diameter Dn measured was 1.07. Note that these values were measured in the same manner as in Example 1. Table 1 shows the measurement result.

| | |
|---|---|
| ethyl acetate solution having a solid content of 50% by mass composed of a polyester resin | 130 parts by mass |
| ethyl acetate solution having a solid content of 50% by mass composed of a styrene-n-butyl acrylate copolymer resin | 43 parts by mass |
| colorant dispersion liquid | 42 parts by mass |
| wax dispersion liquid | 25 parts by mass |
| ethyl acetate | 10 parts by mass |

Note that 130 parts by mass of the ethyl acetate solution having a solid content of 50% by mass composed of a polyester resin and 43 parts by mass of the ethyl acetate solution having a solid content of 50% by mass composed of a styrene-n-butyl acrylate copolymer resin were mixed, the mixture solution was applied onto a transparent PET film using a wire bar, and dried, and then it was confirmed that the coat film became white turbid and these resins were incompatible with each other.

Example 7

A "black toner g" and a developer were prepared in a similar manner to Example 4, except that the mass ratio of the polyester resin to the styrene-n-butyl acrylate copolymer resin was changed to 50/50.

The obtained black toner g had an average circularity of 0.96 and a volume average particle diameter Dv of 4.6 μm; and the Dv/Dn ratio of the volume average particle diameter Dv to a number average particle diameter Dn measured was 1.05. Note that these values were measured in the same manner as in Example 1. Table 1 shows the measurement result.

| | |
|---|---|
| ethyl acetate solution having a solid content of 20% by mass composed of a polyester resin | 217 parts by mass |
| ethyl acetate solution having a solid content of 20% by mass composed of a styrene-n-butyl acrylate copolymer resin | 217 parts by mass |
| colorant dispersion liquid | 42 parts by mass |
| wax dispersion liquid | 25 parts by mass |
| ethyl acetate | 167 parts by mass |

Note that 217 parts by mass of the ethyl acetate solution having a solid content of 20% by mass composed of a polyester resin and 217 parts by mass of the ethyl acetate solution having a solid content of 20% by mass composed of a styrene-n-butyl acrylate copolymer resin were mixed, the mixture solution was applied onto a transparent PET film using a wire bar, and dried, and then it was confirmed that the coat film became white turbid and these resins were incompatible with each other.

Example 8

A "black toner h" and a developer were prepared in a similar manner to Example 4, except that the mass ratio of the polyester resin to the styrene-n-butyl acrylate copolymer resin was changed to 25/75.

The obtained black toner h had an average circularity of 0.97 and a volume average particle diameter Dv of 4.5 μm; and the Dv/Dn ratio of the volume average particle diameter Dv to a number average particle diameter Dn measured was 1.05. Note that these values were measured in the same manner as in Example 1. Table 1 shows the measurement result.

| | |
|---|---|
| ethyl acetate solution having a solid content of 20% by mass composed of a polyester resin | 108 parts by mass |
| ethyl acetate solution having a solid content of 20% by mass composed of a styrene-n-butyl acrylate copolymer resin | 325 parts by mass |
| colorant dispersion liquid | 42 parts by mass |
| wax dispersion liquid | 25 parts by mass |
| ethyl acetate | 167 parts by mass |

Note that 108 parts by mass of the ethyl acetate solution having a solid content of 20% by mass composed of a polyester resin and 325 parts by mass of the ethyl acetate solution having a solid content of 20% by mass composed of the styrene-n-butyl acrylate copolymer resin were mixed, the mixture solution was applied onto a transparent PET film using a wire bar, and dried, and then it was confirmed that the coat film became white turbid and these resins were incompatible with each other.

Example 9

A "black toner i" and a developer were prepared in a similar manner to Example 4, except that in the formulation of the toner composition dispersion liquid, the ethyl acetate solution having a solid content of 20% by mass composed of a polyester resin was changed to an ethyl acetate solution having a solid content of 20% by mass composed of a polyol resin.

The obtained black toner i had an average circularity of 0.96 and a volume average particle diameter Dv of 4.7 μm; and the Dv/Dn ratio of the volume average particle diameter Dv to a number average particle diameter Dn measured was 1.05. Note that these values were measured in the same manner as in Example 1. Table 1 shows the measurement result.

The "polyol resin" is a polyether polyol resin having an epoxy skeleton, and can be obtained by polymerization of a bisphenol A epoxy resin, a glycidyl compound of bisphenol A ethylene oxide adducts, bisphenol F or p-cumylphenol under a nitrogen atmosphere at a reaction temperature of 175° C. for 10 hours. The mass average molecular mass of the polyol resin measured by gel permeation chromatography (GPC) was 21,000, and a ratio (Mw/Mn) of the mass average molecular mass to a number average molecular mass (Mn) was 4.2.

Note that 325 parts by mass of the ethyl acetate solution having a solid content of 20% by mass composed of the polyol resin and 108 parts by mass of the ethyl acetate solution having a solid content of 20% by mass composed of a styrene-n-butyl acrylate copolymer resin were mixed, the mixture solution was applied onto a transparent PET film using a wire bar, and dried, and then it was confirmed that the coat film became white turbid and these resins were incompatible with each other.

Example 10

A "black toner j" and a developer were prepared in a similar manner to Example 4, except that in the formulation of the toner composition dispersion liquid, the ethyl acetate solution having a solid content of 20% by mass composed of a styrene-n-butyl acrylate copolymer resin was changed to an ethyl acetate solution having a solid content of 20% by mass composed of a styrene-butadiene copolymer resin.

The obtained black toner j had an average circularity of 0.97 and a volume average particle diameter Dv of 5.0 μm; and the Dv/Dn ratio of the volume average particle diameter Dv to a number average particle diameter Dn measured was 1.06. Note that these values were measured in the same manner as in Example 1. Table 1 shows the measurement result.

Hereinafter, the synthesis method and characteristics of the styrene-butadiene copolymer resin will be described.

In a 10 L pressure-resistant polymerization tank equipped with a stirrer and a jacket, 4,800 parts by mass of ethyl acetate and 1,131 parts by mass of styrene monomer were added, the mixture was cooled to approximately −8° C. with stirring, and 169 parts by mass of a liquefied butadiene monomer, which had been cooled to a temperature lower than −8° C., were added to the mixture, and sufficiently stirred.

Further, 0.15 parts by mass of powder of ferrous chloride and 23.4 parts by mass of t-hexylperoxybenzoate were added to the mixture, stirred, and the temperature of the system was increased to 65° C. while keeping pressure, and the state of the system was kept for 12 hours. Thereafter, the system was once cooled to 10° C. and then purged at normal pressure. Further, the temperature of the system was raised and then aged for 3 hours under reflux of the ethyl acetate, thereafter, the system was cooled, and an ethyl acetate solution of styrene-butadiene resin was thus obtained. As a result of the analysis of thus obtained styrene-butadiene resin by thermal decomposition gas chromatograph, it was confirmed that the styrene content was 88%, the butadiene content was 12%, and the solid content was 20.5% by mass. As to the molecular mass of the styrene-butadiene resin measured by GPC, the mass average molecular mass was 34,000 and the glass transition temperature was 57° C.

Note that 325 parts by mass of the ethyl acetate solution having a solid content of 20% by mass composed of the polyester resin and 108 parts by mass of the ethyl acetate solution having a solid content of 20% by mass composed of a styrene-butadiene copolymer resin were mixed, the mixture solution was applied onto a transparent PET film using a wire bar, and dried, and then it was confirmed that the coat film became white turbid and these resins were incompatible with each other.

Comparative Example 1

A "black toner k" and a developer were prepared in a similar manner to Example 4, except that the formulation amount of the toner composition dispersion liquid was changed as follows, and the binder resins were changed to only the polyester resin.

The obtained black toner k had an average circularity of 1.00 and a volume average particle diameter Dv of 4.6 μm; and the Dv/Dn ratio of the volume average particle diameter Dv to a number average particle diameter Dn measured was 1.04. Note that these values were measured in the same manner as in Example 1. Table 1 shows the measurement result.

| | |
|---|---|
| ethyl acetate solution having a solid content of 20% by mass composed of a polyester resin | 434 parts by mass |
| colorant dispersion liquid | 42 parts by mass |
| wax dispersion liquid | 25 parts by mass |
| ethyl acetate | 167 parts by mass |

Comparative Example 2

A "black toner l" and a developer were prepared in a similar manner to Example 4, except that the formulation amount of the toner composition dispersion liquid was changed as follows, and the binder resins were changed to only the styrene-n-butyl acrylate copolymer resin.

The obtained black toner l had an average circularity of 0.99 and a volume average particle diameter Dv of 5.0 μm; and the Dv/Dn ratio of the volume average particle diameter Dv to a number average particle diameter Dn measured was 1.06. Note that these values were measured in the same manner as in Example 1. Table 1 shows the measurement result.

| | |
|---|---|
| ethyl acetate solution having a solid content of 20% by mass composed of a styrene-n-butyl acrylate copolymer resin | 434 parts by mass |
| colorant dispersion liquid | 42 parts by mass |
| wax dispersion liquid | 25 parts by mass |
| ethyl acetate | 167 parts by mass |

Next, the developers of Examples 1 to 10 and Comparative Example 1 to 2 were evaluated as to their cleanability according to the following manner. Table 1 shows the evaluation results.

<Cleanability>

Each of the developers was set in a commercially available copier (IMAGIO NEO C325, manufactured by Ricoh Company Ltd.), and an image having an image area ratio of 30% was developed, transferred to transfer paper, afterward, in the middle of removing untransferred toner remaining on the photoconductor surface with a cleaning blade, the operation of the copier was stopped, and then the untransferred toner remaining on the photoconductor surface, which had passed through a cleaning step, was transferred onto a white paper sheet using a SCOTCH TAPE (manufactured by Sumitomo 3M Ltd.). In the white paper sheet, 10 sites were selected and measured using a Macbeth reflection densitometer RD514 model, and a difference between the average value and a measurement result when affixing a same tape to a white paper sheet was determined, and the cleanability of each of the developers was evaluated based on the following criteria. Note that as the cleaning blade, a cleaning blade that had been used for cleaning the photoconductor surface after printing 20,000 sheets was used.

[Evaluation Criteria]

A: Excellent: the difference was 0.01 or less.

B: Good: the difference was 0.015 or less.

C: Poor: the difference was more than 0.015.

TABLE 1

| | Volume average particle diameter Dv (μm) | Dv/Dn | Average circularity | Cleanability |
|---|---|---|---|---|
| Ex. 1 | 5.9 | 1.28 | 0.98 | B |
| Ex. 2 | 5.8 | 1.23 | 0.97 | B |
| Ex. 3 | 5.1 | 1.09 | 0.96 | A |
| Ex. 4 | 4.8 | 1.05 | 0.96 | A |
| Ex. 5 | 3.9 | 1.04 | 0.95 | A |
| Ex. 6 | 6.8 | 1.07 | 0.97 | B |
| Ex. 7 | 4.6 | 1.05 | 0.96 | A |
| Ex. 8 | 4.5 | 1.05 | 0.97 | B |
| Ex. 9 | 4.9 | 1.06 | 0.95 | A |
| Ex. 10 | 5.0 | 1.06 | 0.97 | B |
| Compara. Ex. 1 | 4.6 | 1.04 | 1.00 | C |
| Compara. Ex. 2 | 5.0 | 1.06 | 0.99 | C |

INDUSTRIAL APPLICABILITY

The toner of the present invention has monodispersibility and shape irregularity, is excellent in blade cleanability and capable of forming high-definition and high-quality images with high-resolution without substantially causing no degradation in image quality over a long period of time, and therefore, the toner can be favorably used in developers for developing latent electrostatic images in electrophotography, electrostatic recording, electrostatic printing, and the like.

The invention claimed is:

1. A method for producing a toner, comprising:

forming liquid droplets by atomizing a toner composition liquid in a vapor phase, and solidifying the formed liquid droplets, wherein the toner composition is prepared by dissolving or dispersing at least two binder resins and a colorant in an organic solvent, and the at least two binder resins are composed of at least a resin A and a resin B, and wherein a microstructure of resin A and resin B obtained by dissolving or dispersing resin A and resin B in an organic solvent and drying is phase-separated, wherein the toner has an average circularity of 0.93 to 0.98, and wherein in the formation of liquid droplets, the toner composition liquid is periodically discharged from a thin film having a plurality of nozzles provided on a reservoir for reserving the toner composition, by a mechanically vibrating unit so as to form liquid droplets; and the mechanically vibrating unit is any one selected from a vibration generating unit that is formed in a circular ring shape so as to surround the thin film, and that has a vibrating surface formed in parallel with the thin film and vibrating perpendicularly to the thin film.

* * * * *